US009700157B2

(12) United States Patent
Keyvanloo

(10) Patent No.: US 9,700,157 B2
(45) Date of Patent: Jul. 11, 2017

(54) SUSPENSION DEVICE

(71) Applicants: Aydin Keyvanloo, Doncaster (AU); Andreas Gesswein, Rinteln (DE); Liang Tung, Taipei (TW)

(72) Inventor: Aydin Keyvanloo, Doncaster (AU)

(73) Assignees: Andreas Gesswein, Rintein (DE); Liang Tung, Taipei (TW)

( * ) Notice: Subject to any disclaimer, the term of this patent is extended or adjusted under 35 U.S.C. 154(b) by 12 days.

(21) Appl. No.: 14/506,184

(22) Filed: Oct. 3, 2014

(65) Prior Publication Data

US 2015/0173530 A1 Jun. 25, 2015

(30) Foreign Application Priority Data

Dec. 20, 2013 (AU) ..... 2013905100

(51) Int. Cl.
*A47F 5/08* (2006.01)
*A47F 7/00* (2006.01)
(Continued)

(52) U.S. Cl.
CPC ..... *A47F 5/0853* (2013.01); *H01R 4/64* (2013.01); *H01R 25/14* (2013.01); *A47B 2220/0075* (2013.01)

(58) Field of Classification Search
CPC .. A47F 5/0853; A47F 5/08; A47B 2220/0075; A47B 97/001; A47B 96/027; A47B 47/022; A47B 57/045; A47B 57/42; A47B 57/46; A47B 57/52; A47B 57/56; A47B 96/061; A47B 96/068; H01R 25/14; H01R 4/64; H01R 4/2404; H01R 4/245; H01R 4/26; F21V 21/35
(Continued)

(56) References Cited

U.S. PATENT DOCUMENTS 3,894,170 A * 7/1975 Schinzel ..... H01R 25/14 174/99 B
4,919,625 A * 4/1990 Coutre ..... H01R 25/14 439/118
(Continued)

FOREIGN PATENT DOCUMENTS

DE 202008003360 U 6/2008
EP 2344011 7/2011
(Continued)

*Primary Examiner* — Jennifer E Novosad
(74) *Attorney, Agent, or Firm* — Frost Brown Todd LLC

(57) ABSTRACT

A suspension device for receiving plug in elements used for the display of goods includes a substantially horizontally oriented profile rail section having an upper arm, a lower arm and a rear wall defining a passage with a front opening into which the plug in elements are inserted. The upper arm defines a ceiling of the passage and the lower arm defines a base of the passage. The base of the passage includes a base contact surface upon which a plug in element rests. The ceiling of the passage includes a stepped profile defining at least two upper contact surfaces that the top of the plug in elements may contact, such that the vertical distances between the base contact surface and the respective upper contact surfaces differ, whereby plug in elements of at least two different thicknesses can be accommodated and suspended within the passage.

14 Claims, 46 Drawing Sheets

(51) Int. Cl.
*H01R 4/64* (2006.01)
*H01R 25/14* (2006.01)

(58) Field of Classification Search
USPC ..... 211/94.01, 26, 87.01, 86.01, 26.2, 193, 211/90.01–90.04; 362/125–127, 133, 362/145, 147, 647, 648, 640, 249.02, 362, 362/382, 457, 431, 800; 248/235, 307, 248/317; 174/480–507; 439/110–121, 439/660, 638
See application file for complete search history.

(56) References Cited

U.S. PATENT DOCUMENTS 4,973,796 A * 11/1990 Dougherty ..... E04B 2/82 174/494
5,758,585 A * 6/1998 Latchinian ..... A47B 96/067 108/108
6,231,205 B1 * 5/2001 Slesinger ..... A47B 96/02 362/125
6,631,813 B1 * 10/2003 Walter ..... A47F 5/0846 211/123
7,122,744 B2 * 10/2006 Walter ..... A47B 97/00 174/161 R
7,256,346 B2 * 8/2007 Walter ..... A47B 96/14 174/481
7,591,385 B2 * 9/2009 Brooks ..... B25H 3/04 211/70.6
2004/0228122 A1 * 11/2004 Slesinger ..... A47F 11/10 362/127
2005/0173605 A1 * 8/2005 Villeneuve ..... A47F 5/0018 248/301
2013/0107501 A1 * 5/2013 Ewald ..... A47F 5/0853 362/145
2015/0173530 A1 * 6/2015 Keyvanloo ..... A47F 5/0853 439/110

FOREIGN PATENT DOCUMENTS

EP 2492899 8/2012
WO WO 2010/015332 2/2010

* cited by examiner

SUSPENSION DEVICE

FIELD OF THE INVENTION

The present invention relates to a suspension device for receiving plug in elements, such as arms and shelving components, for the display of goods. The present invention finds particular, though not exclusive, application in a retail display environment.

BACKGROUND OF THE INVENTION

In retail stores, clothing and goods for sale are typically presented on display arms or shelving units that generally form part of a standalone display stand or are mounted on walls or other large display units.

Garments for example are typically hung from hangers, which are then suspended from the arms. The arms are either straight poles or are equipped with dividers to space out the hangers and garments to ensure all garments are visible. Other items, such as folded apparel, are generally presented on shelving. Shelving is used for the display of many non-hangable items.

In retail environments, it is often desirable to change the way in which items are presented for sale, particularly as stock changes. In some instances display arms are the preferred manner of presenting items whereas on other occasions display shelves are more desirable.

It is also desirable in retail environments to be able to readily mount display arms and shelves at various vertical positions on a wall depending on the items to be displayed.

Horizontal mounting systems are known and typically comprise a profile rail that sits within a wall surface and has an opening into which supports can be inserted. As an alternative to a longitudinal profile rail, a socket may be recessed into a wall surface for the insertion of supports. However, known systems require a specific corresponding engagement member on the end of the support for insertion into the opening, and lack a certain degree of flexibility.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

SUMMARY OF THE INVENTION

According to a first aspect, the present invention provides a suspension device for receiving plug in elements used for the display of goods, the device including:

a substantially horizontally oriented profile rail section having an upper arm, a lower arm and a rear wall defining a passage with a front opening into which the plug in elements are inserted;

the upper arm defines a ceiling of the passage and the lower arm defines a base of the passage;

wherein the base of the passage includes a base contact surface upon which a plug in element rests; and wherein the ceiling of the passage includes a stepped profile defining at least two upper contact surfaces that the top of the plug in elements may contact, such that the vertical distances between the base contact surface and the respective upper contact surfaces differ, whereby plug in elements of at least two different thicknesses can be accommodated and suspended within the passage.

Preferably, there is a first vertical distance and a second vertical distance, with the first vertical distance being greater than the second vertical distance. The first vertical distance may be closer to the opening than the second vertical distance.

The suspension device may be provided as an integral extrusion. Alternatively, an extrusion may be provided with an upper channel into which an insert may be placed. The insert preferably includes the stepped profile section. The insert may be constructed from an electrically insulating material. Electrical conductors are preferably integrated into the suspension device, and may comprise two copper wires running a substantial length of the profile rail section. The copper wires are preferably held within channels provided in the electrically insulating insert that creates the stepped section, such that a first electrical conductor is exposed at a first upper contact surface and a second electrical conductor is exposed at a second upper contact surface, such that when a plug in element is inserted into the passage, the top surface of the plug in element only directly contacts one electrical conductor and is advantageously prevented from simultaneously directly contacting a second electrical conductor. The plug in elements, for example an arm or a shelf, are preferably inserted in a generally horizontal orientation.

The profile rail section may be of any length. A short section may be provided and integrated into a holder or socket for a single plug in element. Alternatively a predetermined length may extend over a section of a vertical wall surface, inserted into an aperture made in the vertical wall surface. Another construction may include a profile rail section that extends the full length of a vertical wall surface, and may be part of the wall construction such that floating panels are inserted between a series of vertically spaced apart profile rail sections.

The rear wall is preferably angled to minimise the amount of light reflected back out of the profile rail. This in turn provides a visually darkened profile rail passage when viewed from the front opening. The front opening is preferably tapered leading into the passage.

The lower arm preferably includes one or more sections creating the base contact surface that are located towards the front of the passage. The upper contact surfaces are preferably located toward the rear of the passage. Therefore a plug in element is held in a cantilevered fashion. Rearward of the base contact surface, the internal surface of the lower arm may slope downwardly towards the rear wall. This construction can assist in the insertion and removal of a cantilevered plug in element, with the upper arm preferably having a section defining an elevated ceiling contact surface in front of the upper contact surfaces. This allows for a plug in element to be presented in a upwardly angled orientation and then lowered to substantially horizontal when inserted, and conversely lifted for removal.

The plug in elements may be arms for the suspension of articles, such as garment hangers, or may be shelves. The plug in section of the elements is preferably of rectangular cross-section having a uniform thickness. A rear end of the plug in element preferably abuts against a vertical section of the stepped profile or a section of the rear wall to prevent further insertion and contact with the appropriate upper contact surface.

A rear top surface of the plug in element may include an exposed electrically conductive section, such that on contact with an electrical conductor in an upper contact surface electrical current is conducted from the electrical conductor to the exposed conductive section and through a plug in element containing electrically conductive elements to light emitting devices, such as diodes, connected to or embedded within the plug in element or alternative power outlets, such as USB plugs.

The plug in element may be a shelf made from a laminated product, such as a sandwich board comprising a core of electrically insulating material, such as polyethylene, the core being sandwiched between two layers of electrically conducting material, such as thin aluminium sheets. This construction can be known as an Aluminium Composite Panel (ACP) or Aluminium Composite Material (ACM), available under the trademark Dibond™. The sandwich panel is preferably coated, such as with a polyester coating. To expose an electrically conductive section, the coating is machined away, this may be done along the rear upper surface of the shelf to expose the upper aluminium layer for contact with an electrical conductor.

A bracket is preferably used to conduct electricity from the second electrical conductor to the lower aluminium layer. A rear of the bracket may contact the rearmost electrical conductor and the front of the bracket may be connected to the underside of the shelf, where a section of coating has preferably been exposed.

More generally, in a second aspect of the invention, there is provided a composite panel having a core layer of electrically insulating material sandwiched between outer electrically conductive layers having respective outer faces, which panel carries at an edge a bracket that includes, outwardly of the edge, an electrical contact at a level offset from the outer face of one of said electrically conductive layers, wherein the bracket provides an electrical connection between said electrical contact and the other of said electrically conductive layers.

Light emitting devices, which may include diodes, are preferably partially or fully embedded within the underside of the panel or shelf. The light emitting devices preferably include an anode pin and a cathode pin, such that one of the pins is connected to the upper conductive sheet and the other pin is connected to the lower conductive sheet. When plugged into the suspension device, the two electrical conductors transfer electrical current to the diodes via the two conductive sheets.

The suspension device may further include a slide-in location control element in said passage having structure to receive co-operating formations on respective plug in elements at defined locations along the profile rail section, and to lock the plug in element in place when the plug in element is tilted from an insertion orientation to an engaged orientation.

More generally, in a third aspect of the invention, there is provided a suspension device for receiving plug in elements used for the display of goods, the device comprising: a substantially horizontally oriented profile rail section having an upper arm, a lower arm and a rear wall defining a passage with a front opening into which the plug in elements are inserted; wherein the upper arm defines a ceiling of the passage and the lower arm defines a base of the passage; wherein the base of the passage includes a base contact surface upon which a plug in element rests; and a slide-in location control element in said passage having structure to receive co-operating formations on respective plug in elements at defined locations along the profile rail section, and to lock the plug in element in place when the plug in element is tilted from an insertion orientation to an engaged orientation.

In an embodiment of the suspension device, the profile rail section has, respectively above and below said front opening at spaced intervals, structure for detachably retaining panels that bridge one or more of the profile rail sections when spaced vertically.

More generally, in a fourth aspect of the invention, there is provided a suspension device for receiving plug in elements used for the display of goods, the device comprising: a substantially horizontally oriented profile rail section having an upper arm, a lower arm and a rear wall defining a passage with a front opening into which the plug in elements are inserted; wherein the upper arm defines a ceiling of the passage and the lower arm defines a base of the passage; wherein the base of the passage includes a base contact surface upon which a plug in element rests; and wherein the profile rail section has, respectively above and below said front opening at spaced intervals, structure for detachably retaining panels that bridge one or more of the profile rail sections when spaced vertically.

The invention further extends to any two or more of the aforesaid aspects of the invention in combination.

Further aspects of the present invention and further embodiments of the aspects described in the preceding paragraphs will become apparent from the following description, given by way of example and with reference to the accompanying drawings.

BRIEF DESCRIPTION OF THE DRAWINGS

The invention will now be described, by way of example only, with reference to the accompanying drawings, in which.

DETAILED DESCRIPTION OF THE EMBODIMENTS

Figure 1:
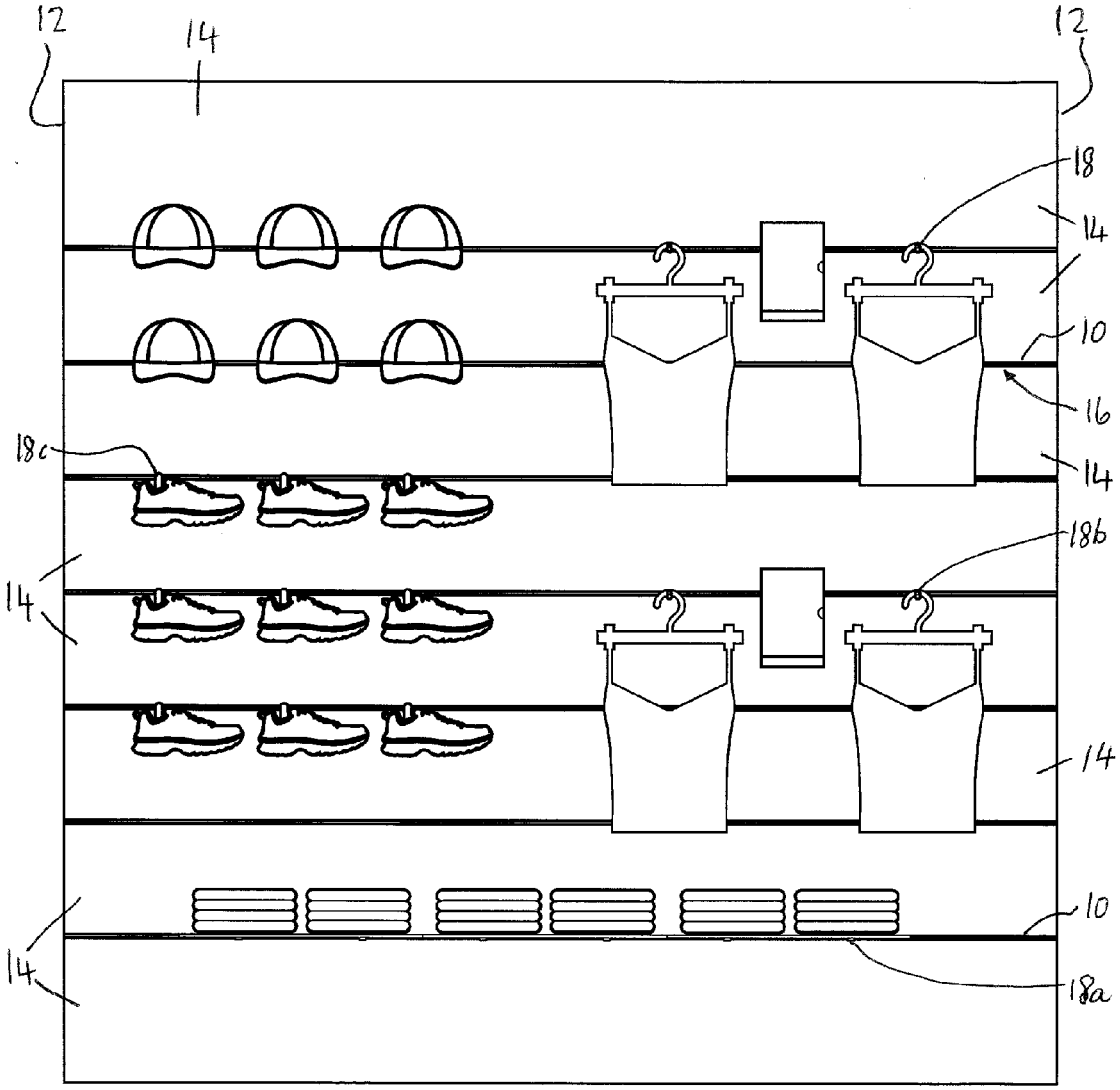
FIG. 1 is a general front view of a merchandising display system including a plurality of suspension devices according to the invention.

A merchandising display system is shown in FIG. 1, and includes a plurality of vertically spaced apart suspension devices 10 that extend substantially horizontally and have a length that is continuous to the edges 12 of the display. The plurality of horizontal suspension devices 10 are spaced apart by vertically oriented wall sections 14; the suspension devices 10 and wall sections 14 together forming a vertical wall surface. The suspension devices 10 each include a passage 16 into which plug in elements 18 can be inserted and suspended for use in the display of goods. The plug in elements 18 may be, for example, shelves 18*a* for goods to be placed on, arms 18*b* for hangers to suspend from, or hooks 18*c* for goods to hang off. Any configuration of plug in element is contemplated.

Figure 42:
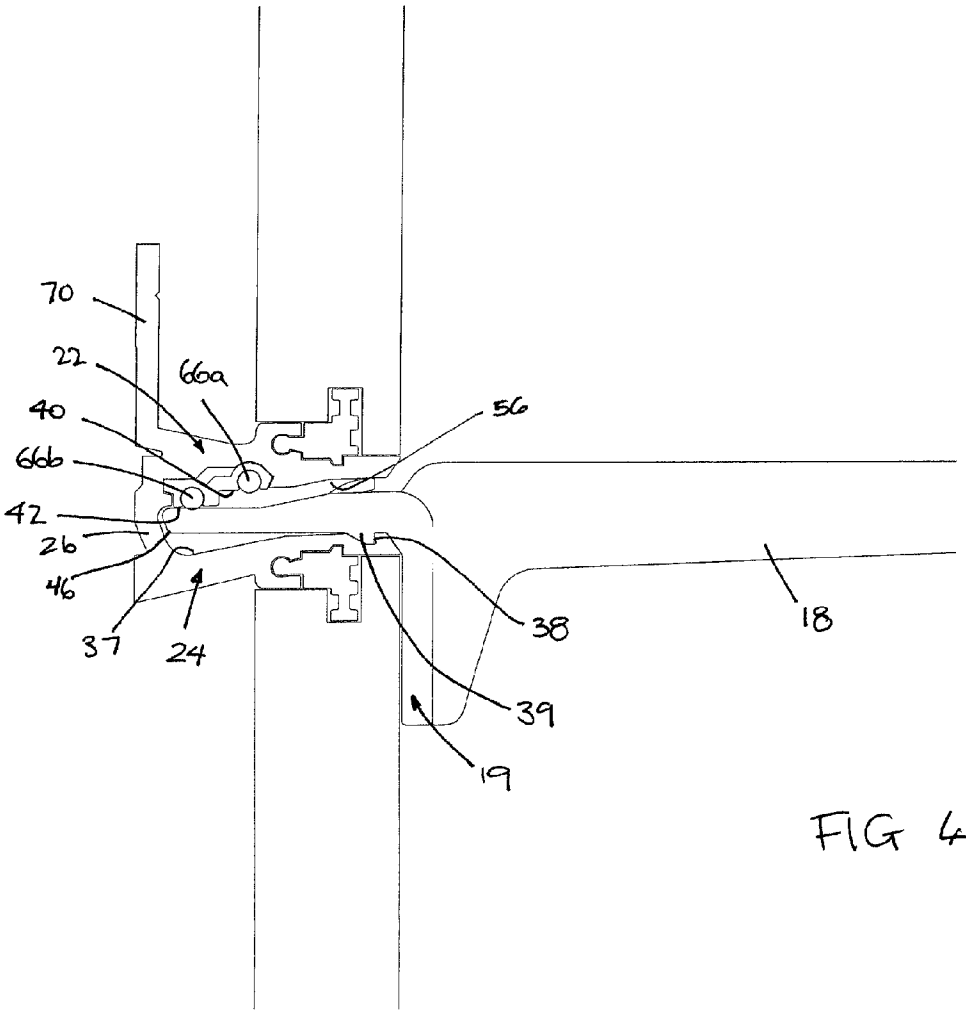
FIG. 42 is an end view corresponding to FIGS. 39 and 40 but with an arm inserted.

The suspension device includes a substantially horizontally oriented profile rail section 20. FIGS. 2 and 3, 4 to 6 and 7 illustrate three alternative profile rail sections, the differences to be described further below, however both include an upper arm or strut 22, a lower arm or strut 24 and a rear wall 26 together defining the passage 16 with front opening 28 into which the plug in elements 18 are inserted. The upper arm 22 defines a ceiling 30 or upper surface of the passage 16 (see FIG. 7) and the lower arm 24 defines a base 32 of the passage 16. The base 32 includes a first contact area 34 adjacent the opening 28 and a second contact area 36, separated by a groove 38. Groove 38 is engaged by protrusions located on the underside of plug in elements 18 (see for example protrusions or ribs 39 in FIG. 42). This creates a positive lock that can be needed for lighter plug in elements that will not stay in place by counter levering alone. The internal surface of base 32 then slopes rearwardly downwards as a rear surface 37, merging into the rear wall 26. The rear wall 26 is angled to the line of sight into the passage 16: this reduces the amount of light that reflects back out the passage opening 28, darkening the passage 16.

The ceiling 30 includes, towards its rear, a stepped profile defining two contact upper contact surfaces 40, 42, that the top of the plug in elements nay contact. A vertical shoulder 48 separates and links the two upper contact surfaces 40, 42. The upper arm 22 may be provided as an integral moulding or extrusion that defines the aforesaid stepped. profile, or alternatively, (not shown) the extrusion is provided with a channel 60 that seats an insert 62 defining the stepped profile. The extrusion. is typically made from. a metal, e.g. steel or aluminium. The insert 62 may be made from a material such as rubber or plastic, so as to provide a frictional surface to assist in gripping the plug in elements as they are retained in the suspension device while projecting cantilevered fashion. It also helps to reduce impact and scratching of plug, in elements, which is particularly important for glass shelves.

Figure 4:
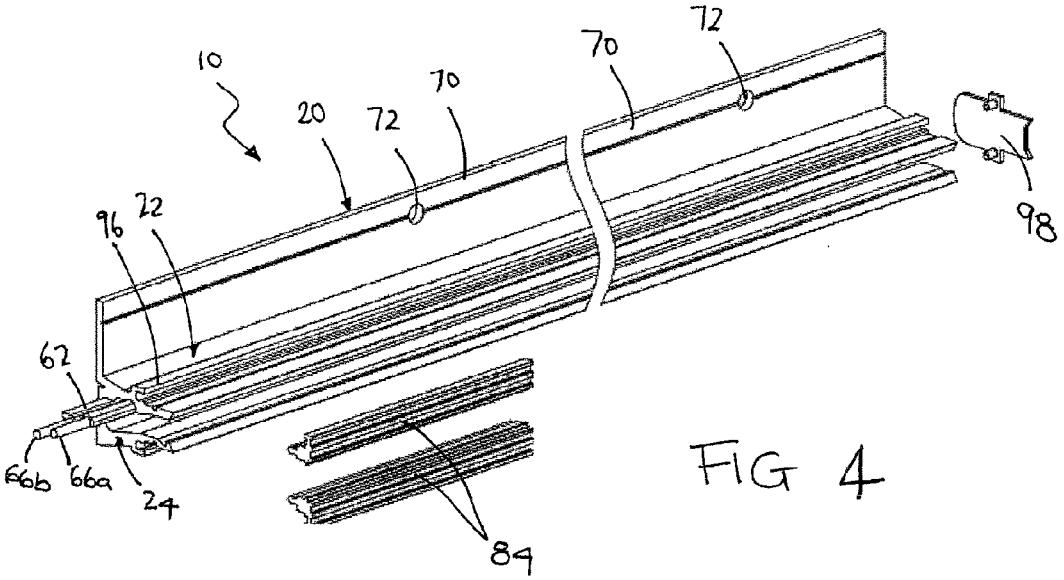
FIG. 4 is a perspective front view of a suspension device according to a second embodiment of the invention.
Figure 5:
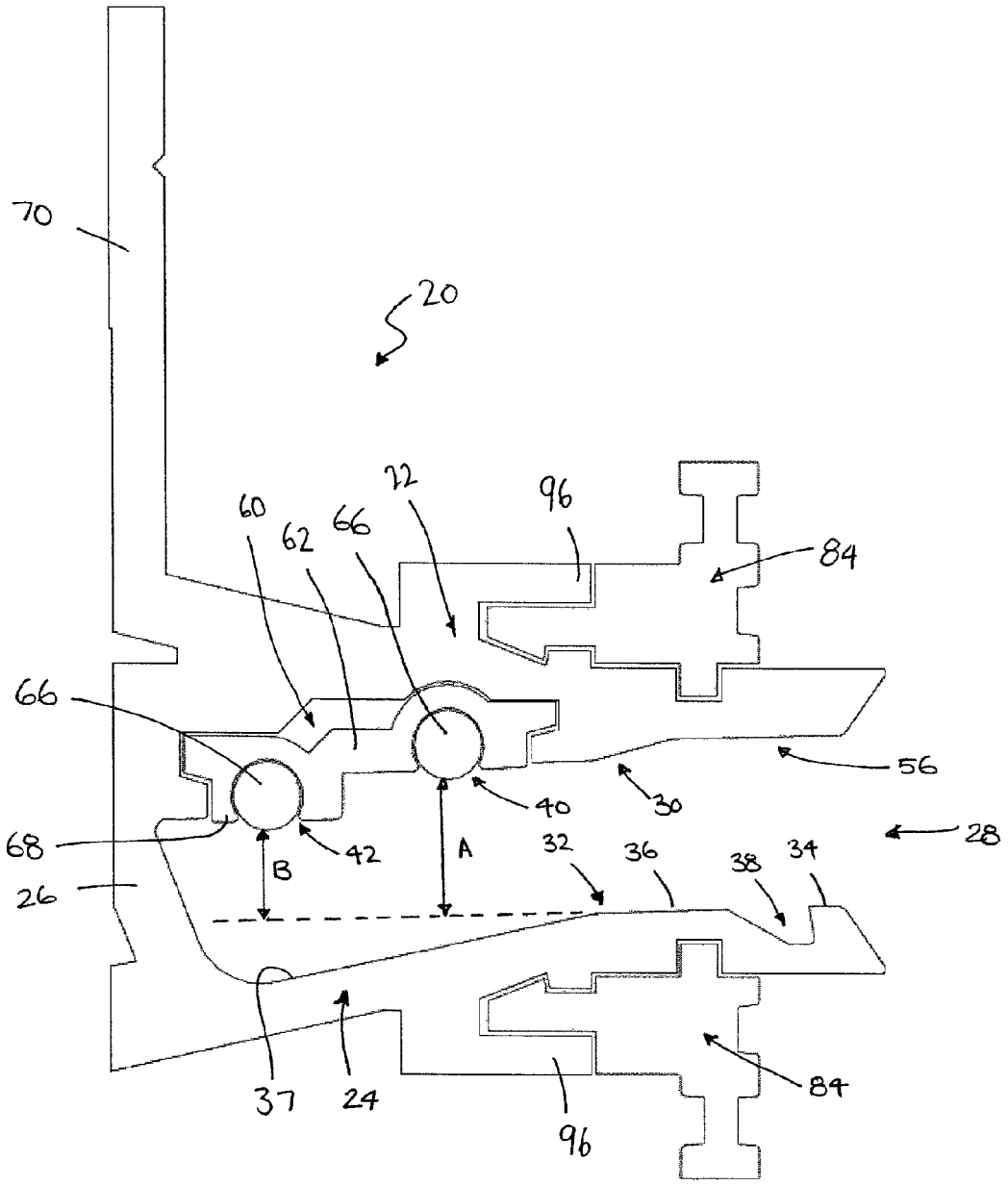
FIG. 5 is an end view of the suspension device shown in FIG. 4.
Figure 6:
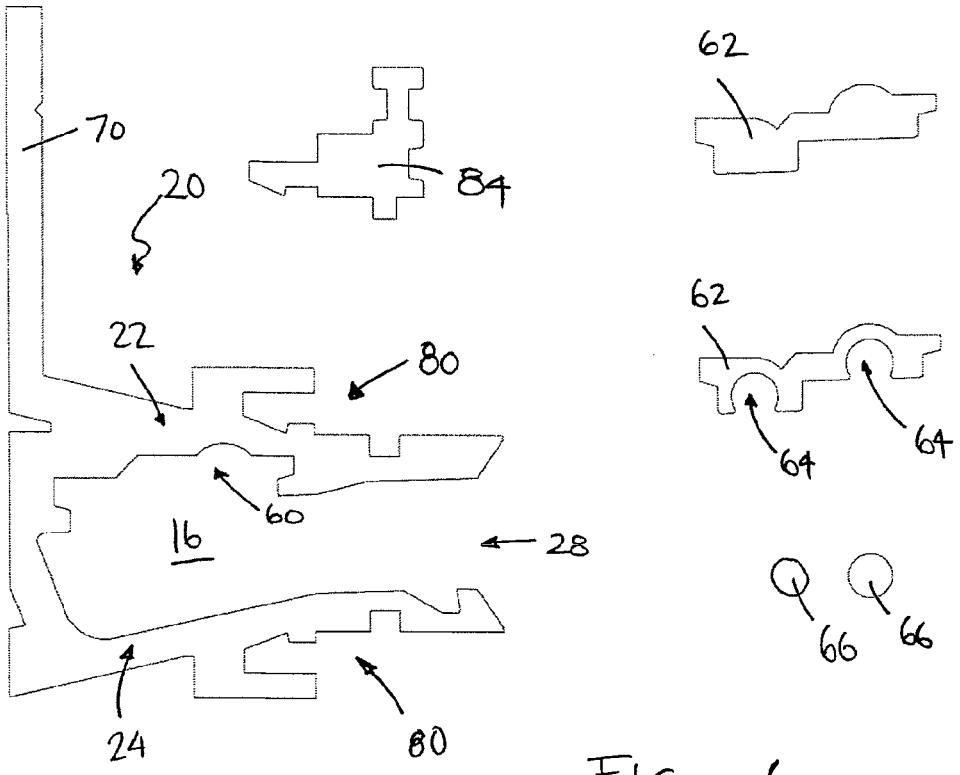
FIG. 6 is an exploded end view of the suspension device of FIGS. 4 and 5.

In a modified embodiment depicted in FIGS. 4 to 6, the insert 62 may include two slightly undercut channels 64 of part-circular cross-section running the length of the profile rail. In this embodiment, the insert 62 is made from an electrically insulating material, and two electrical conductors in the form of copper wires 66 are accommodated within the channels 64 in a press fit connection, with the lower edges 68 of the channels 64 extending slightly underneath to hold the copper wires 66 in position. The insulated insert 62 presents electrical contacts between the aluminium extrusion 30 and the wires 66. Electrification of the profile rail will be described in further detail below.

Figure 3:
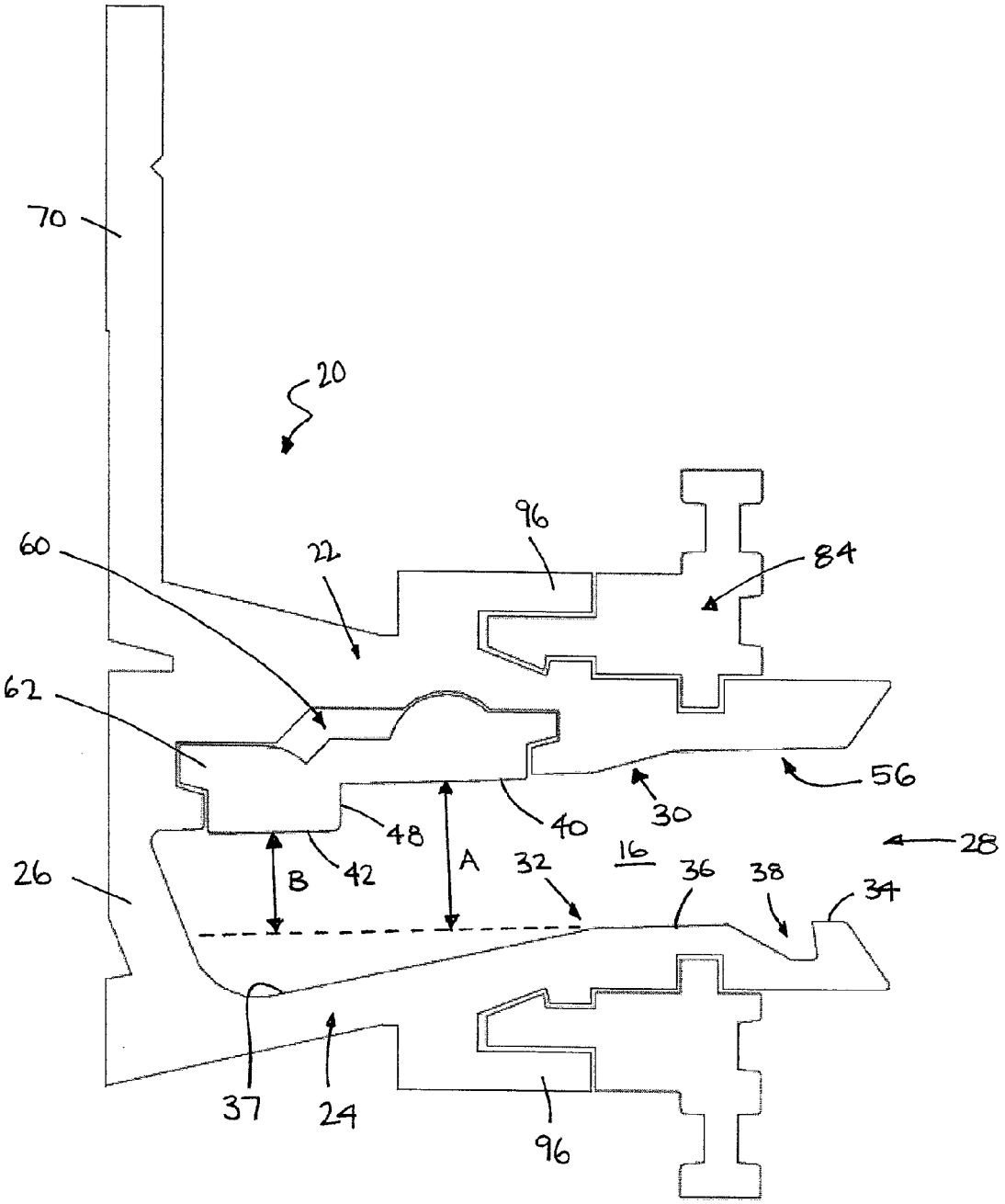
FIG. 3 is an end view of the suspension device of FIG. 2.

As best illustrated in FIG. 3, the vertical distance between the base contact surface 36 and the respective upper contact surfaces 40, 42 differs, as illustrated by arrows A and B. Distance A is a first vertical distance closer to the opening 28 than the second vertical distance B, with distance A being greater than distance B. Distance A may be, for example, 6 mm, with distance B being, for example, 4 mm, such that the shoulder 48 is 2 mm in height. This stepped profile accommodates plug in elements of at least two different thicknesses. It will be appreciated that further steps, especially a third step, could be provided to accommodate further distinct thicknesses of plug in element.

Figure 39:
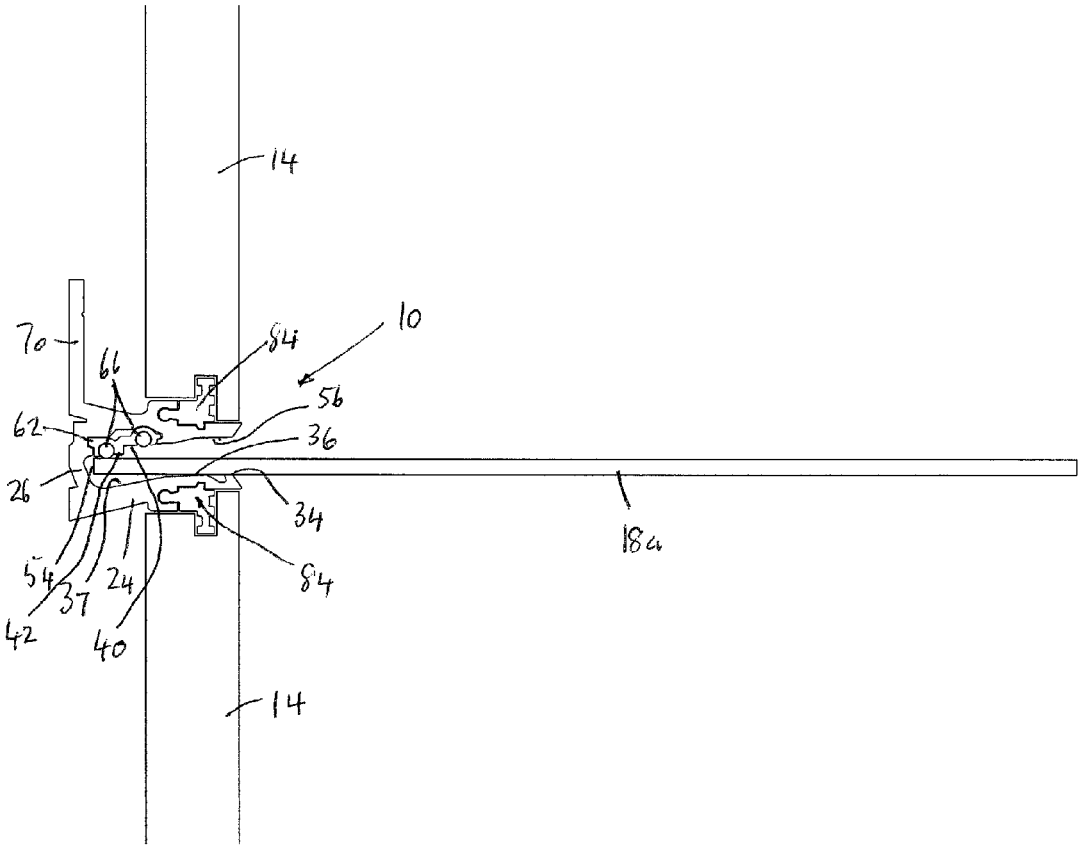
FIG. 39 is an end view of the suspension device of FIG. 11, with a first plug in element of a first thickness engaged with the device.
Figure 40:
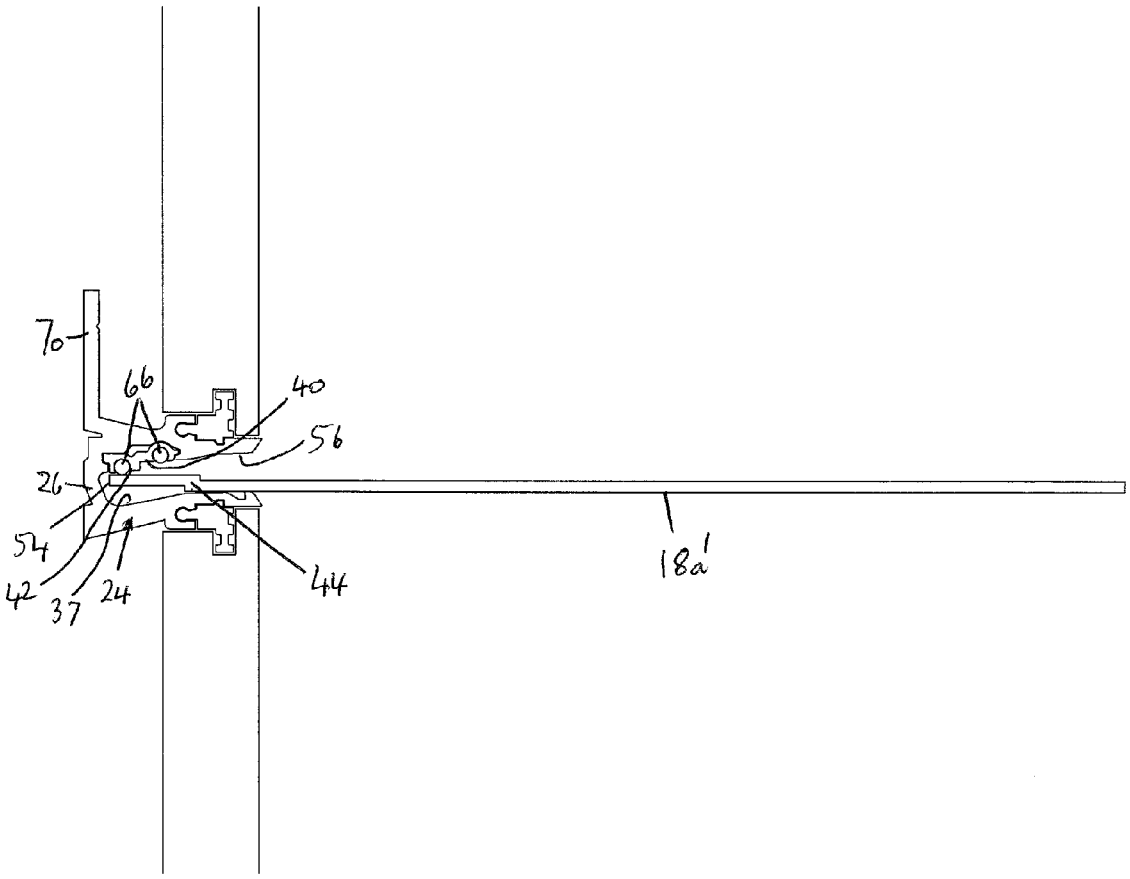
FIG. 40 is an end view corresponding to FIG. 39, but with a second plug in element of a second thickness.
Figure 41:
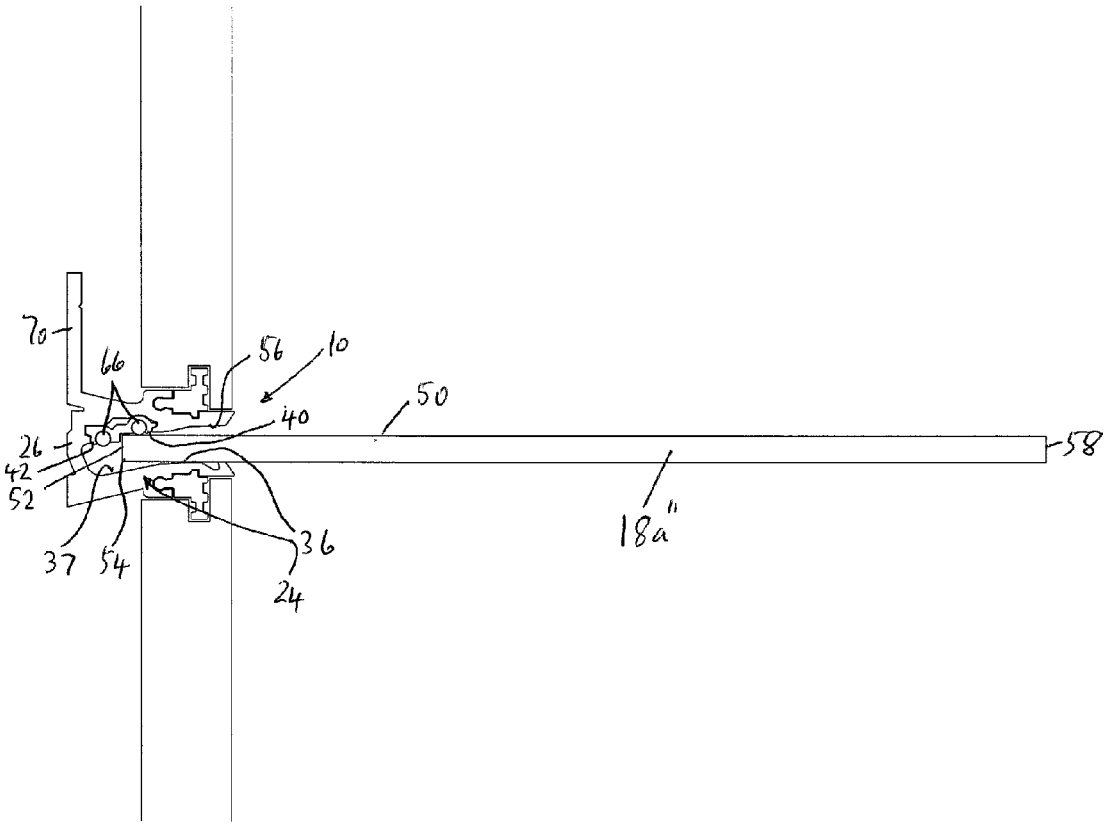
FIG. 41 is an end view corresponding to FIGS. 39 and 40 but with a third plug in element of a third thickness.

FIGS. 39 to 42 best illustrate the suspension of plug in elements 18. FIG. 39 illustrates a plug in element in the form of a shelf 18*a* having a thickness of 4 mm. The shelf 18*a* is accommodated in the rear of the passage, contacting the upper contact surface 42 and lower contact surface 36. FIG. 40 illustrates a plug in element in the form of a shelf 18*a*' of 3 mm thickness. By utilising a double stepped section of 4 mm thickness in the rear of the shelf 18*a*', a short distance from the rear end of the shelf, this 3 mm shelf is also accommodated in the rear of the passage, contacting the upper contact surface 42 and the lower contact surface 36. FIG. 41, however illustrates a shelf 18*a*" having a thickness of 6 mm. When inserted into the passage 16, the rear edge 46 abuts against the vertical shoulder 48 of the stepped profile portion, such that the upper surface 50 of the shelf contacts the upper contact surface 40.

The plug in elements 18 typically have a rear end 46 of rectangular cross-section that abuts either the vertical shoulder 48 with its upper corner edge 52 or the rear wall 26 with its lower corner edge 54, to prevent further insertion.

The ceiling 30 further includes a raised section 56 adjacent the opening 28. This raised ceiling section 56 allows the thicker shelf 18*a*" to project at a slightly angled orientation, such that the outer front edge 58 is higher than the rear edge 46, sloping rearwardly (as best seen in FIG. 41). Additionally, the thinner shelves 18*a* and 18*a*' are also rearwardly sloping, with the combination of the rearwardly sloping base surface 37 and the raised ceiling section 56 allowing for the outer front edge 58 to be raised for removal and insertion.

Figure 2:
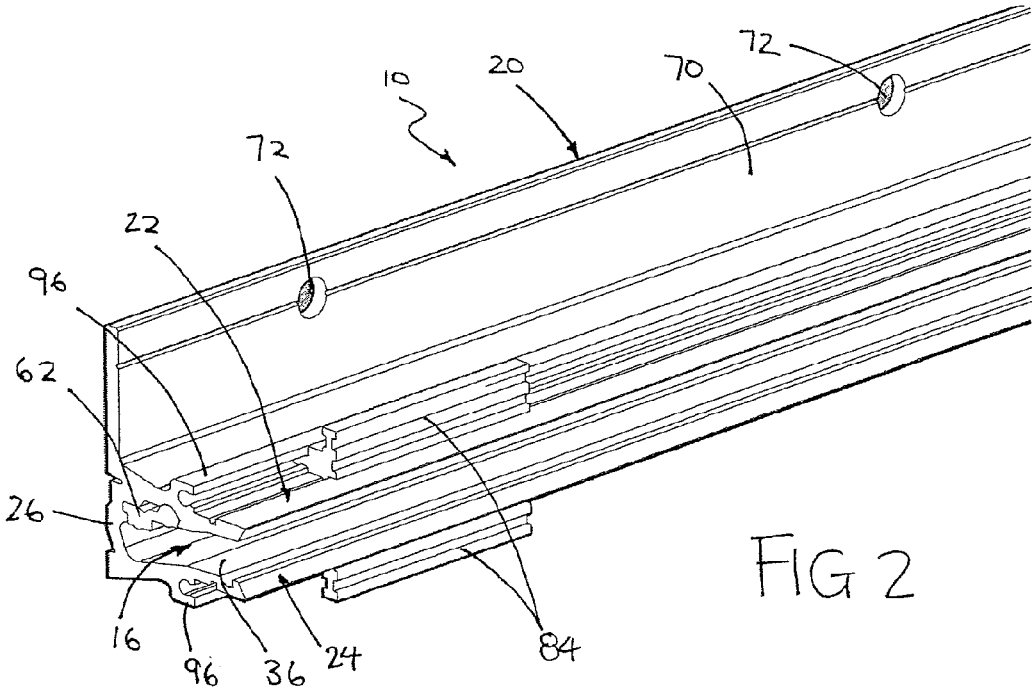
FIG. 2 is a perspective front view of a suspension device according to the first embodiment of the invention.
Figure 8:
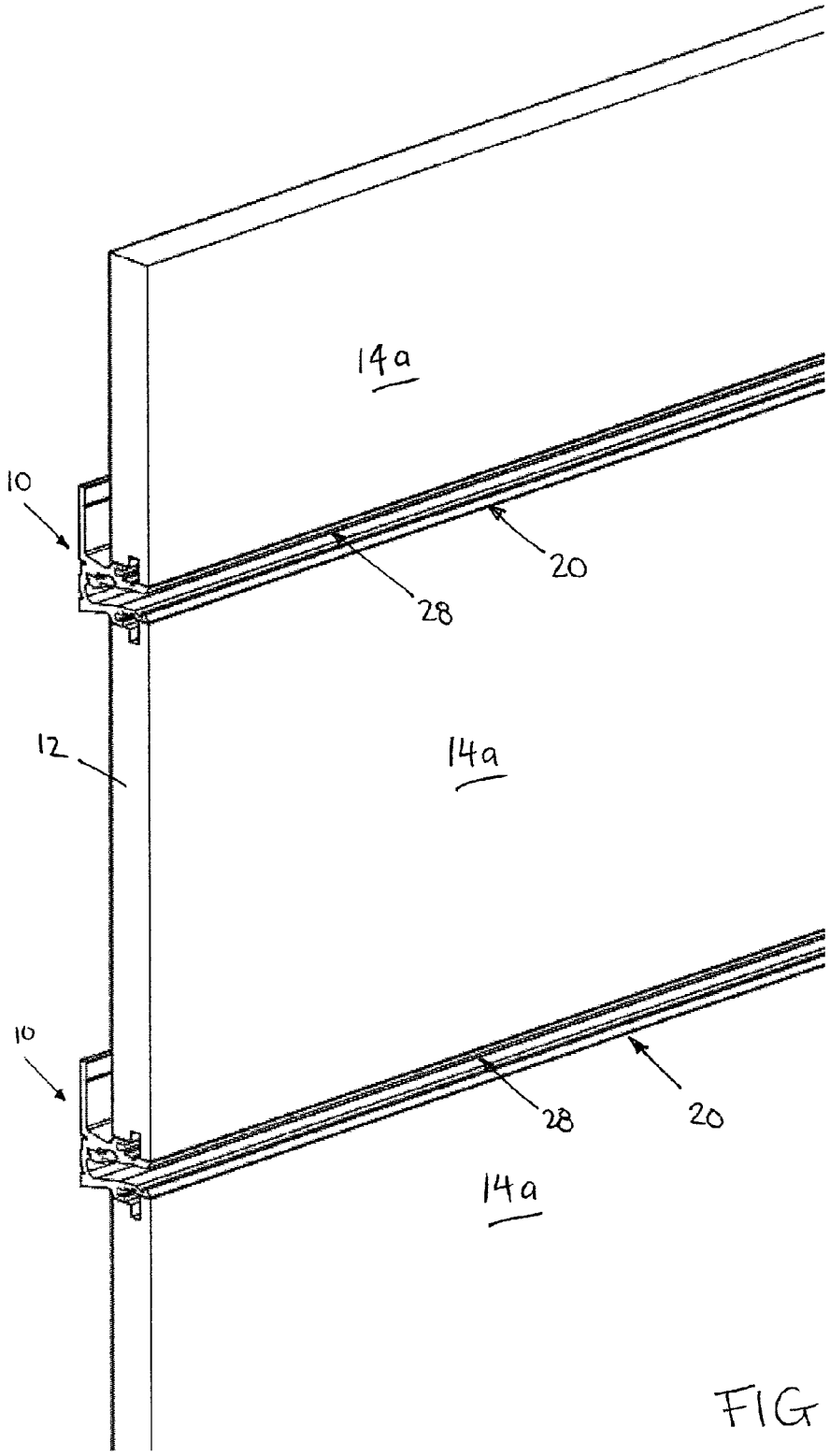
FIG. 8 is a perspective end view of a section of the merchandising display system of FIG. 1.
Figure 9:
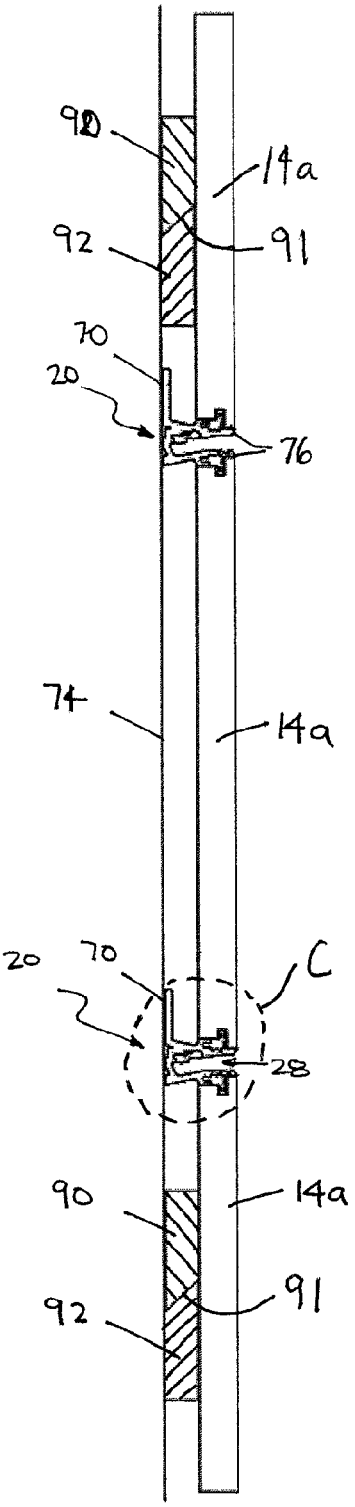
FIG. 9 is a side end view of the merchandising display system as seen in FIG. 8.
Figure 10:
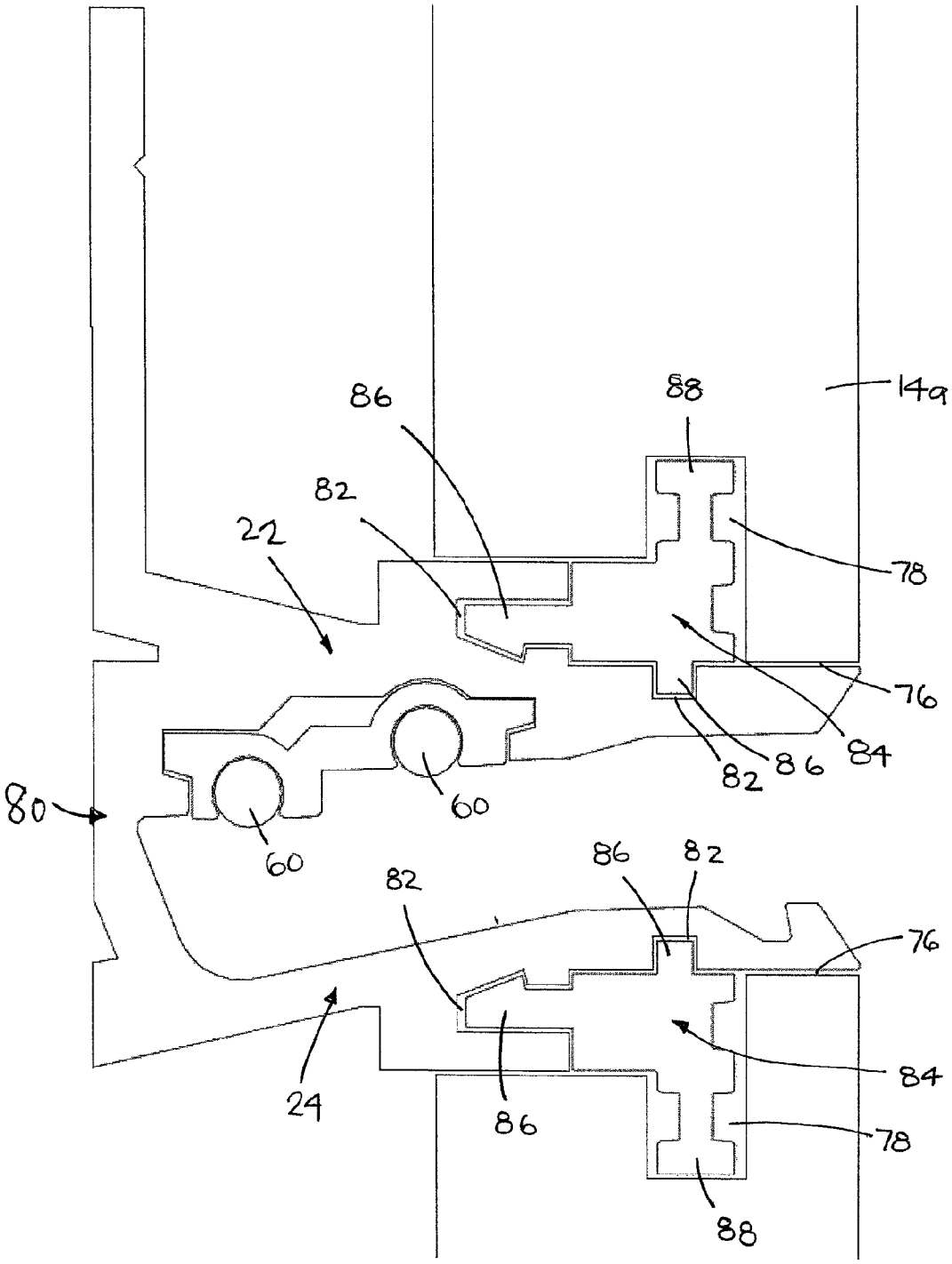
FIG. 10 is an enlargement of the region C in FIG. 9.

FIGS. 2 and 3 illustrate an embodiment of a profile rail section 20 in which the rear wall 26 and the upper arm 22 merge at a junction with an upwardly projecting wall engagement flange 70 with a flat rear surface. Flange 70 includes a plurality of spaced apart apertures 72, by which the profile rail section can be affixed to a permanent wall structure 74, as shown in FIGS. 8 to 10. This profile rail section 20 is used for what is referred to as continuous installations, as shown in FIG. 1, in which separate wall sections 14 are positioned between profile rail sections 20 and continue all the way to the edge of the display wall being created. As shown in FIGS. 9 and 10, a continuous wall can be constructed from wooden panels 14*a*, such as MDF (Medium-density fibreboard) or from plasterboard 14*b*.

Figure 11:
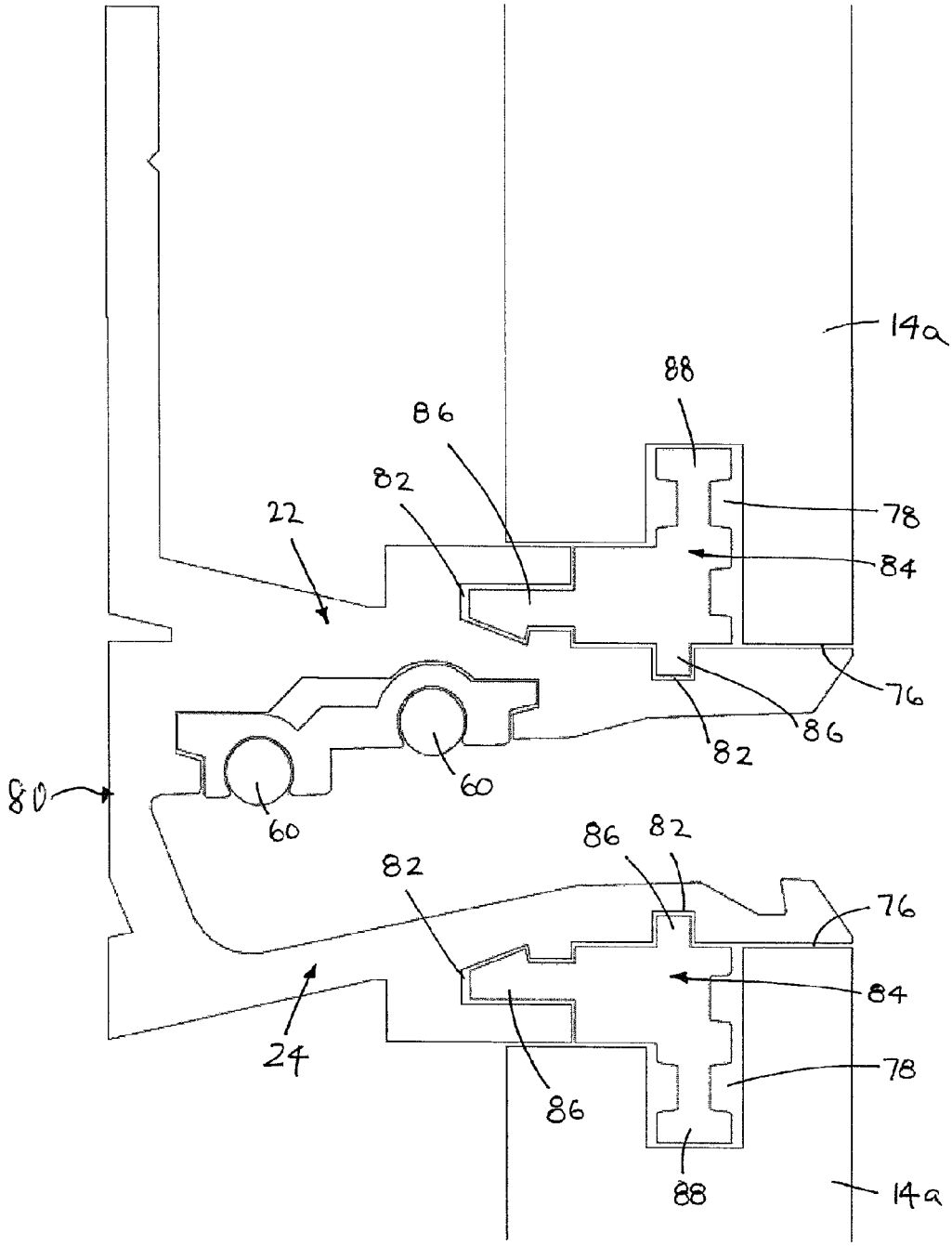
FIG. 11 is a view similar to that of FIG. 10, but depicting an MDF board of lesser thickness.
Figure 19:
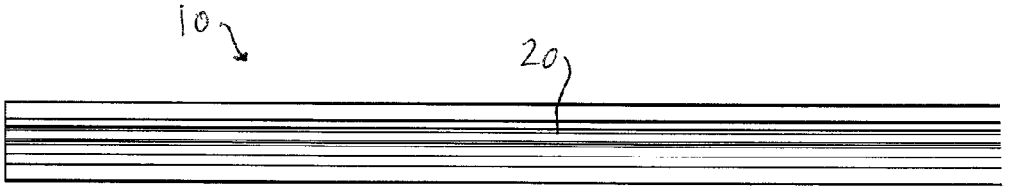
FIG. 19 is a front view of a merchandising display using the suspension device of FIGS. 2 and 3.
Figure 20:
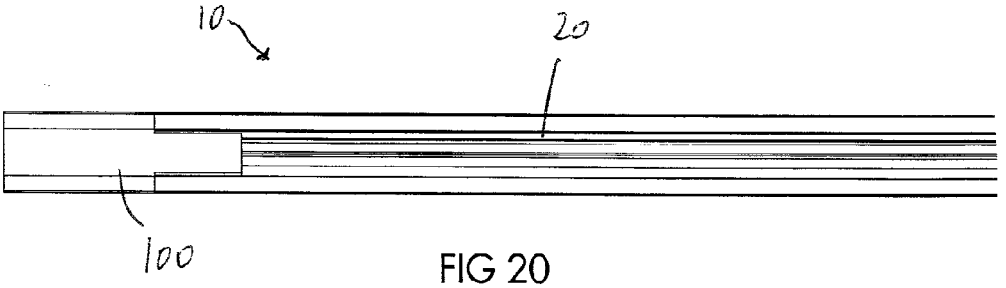
FIG. 20 is a front view of a merchandising display using the suspension device of FIGS. 4 to 6.
Figure 21:
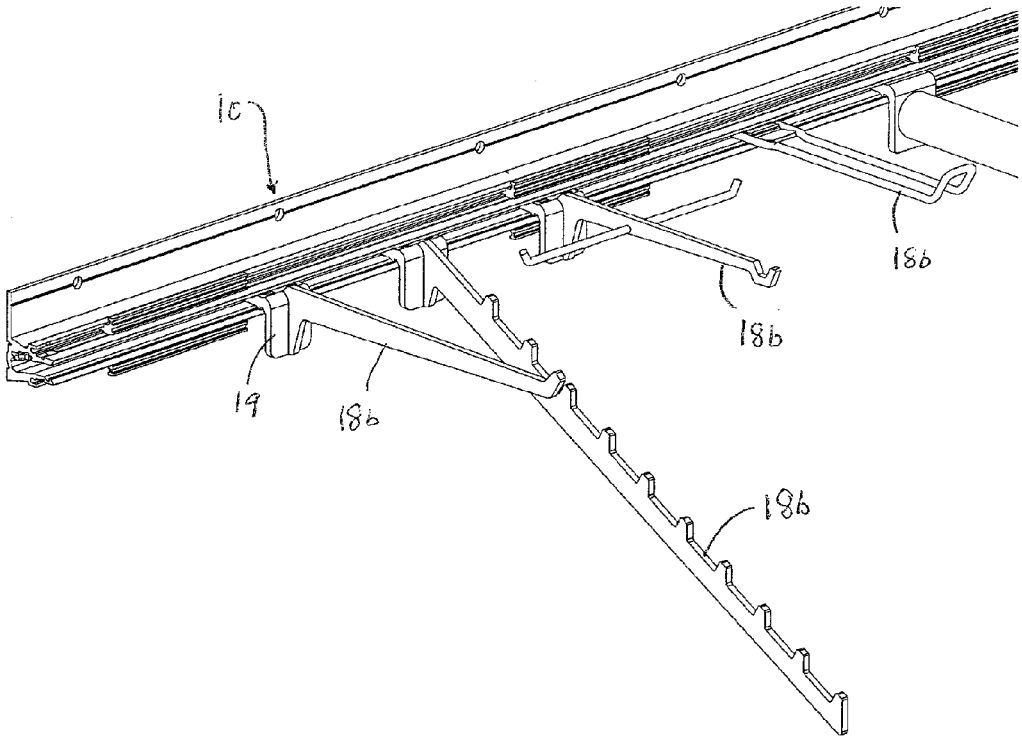
FIG. 21 is a perspective front view of a merchandising display having the suspension device of FIGS. 4 and 5.
Figure 22:
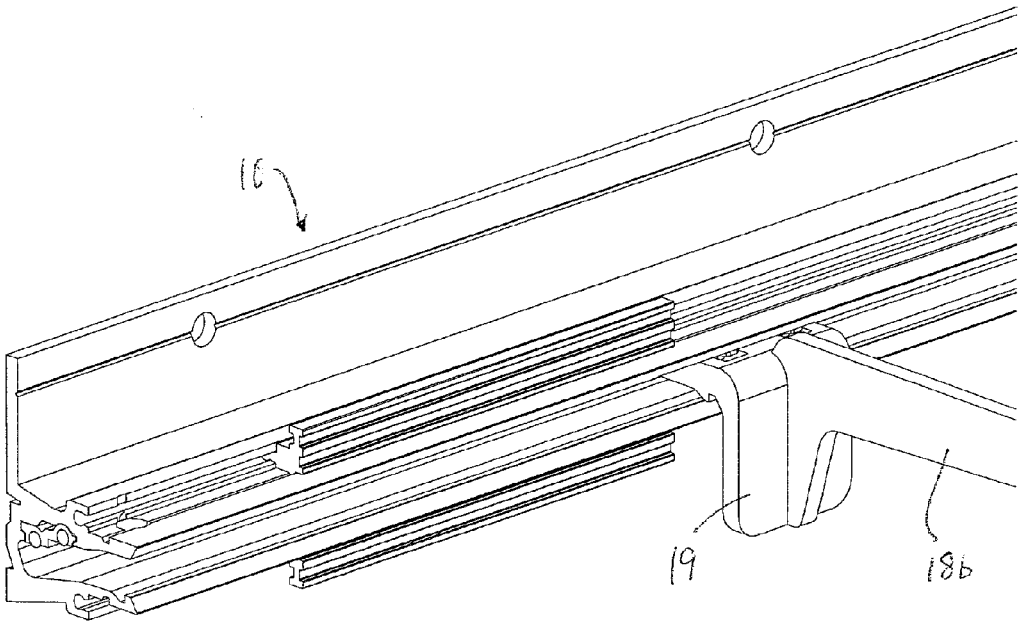
FIG. 22 shows a close up of a portion of FIG. 21.
Figure 23:
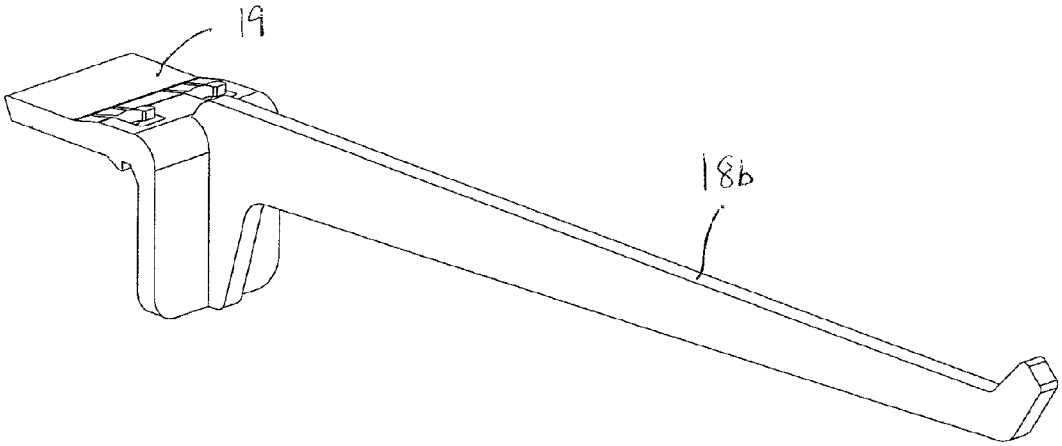
FIG. 23 is a perspective view of a plug-in element.
Figure 24:
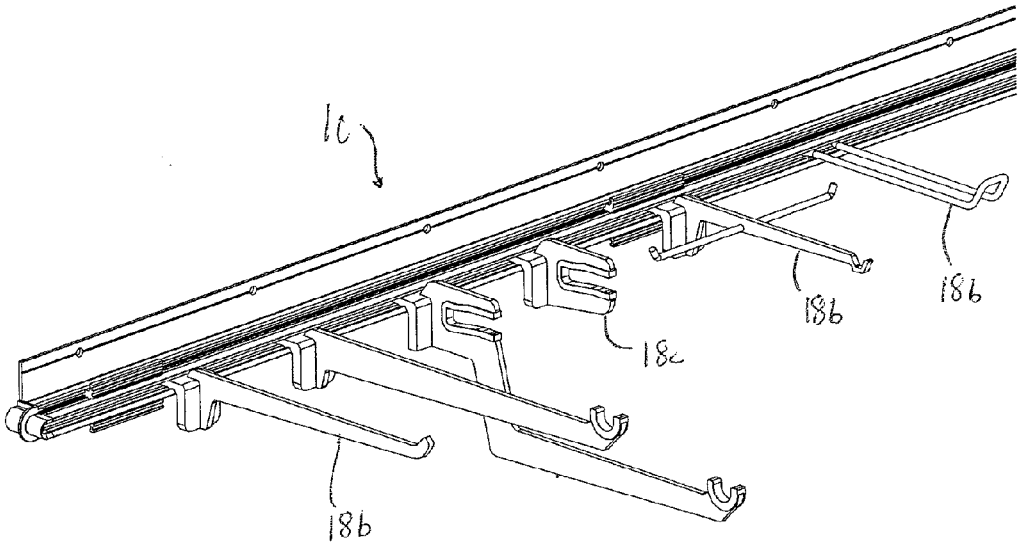
FIG. 24 is a perspective front view of a suspension device according to another embodiment with a variety of plug-in elements.
Figure 25:
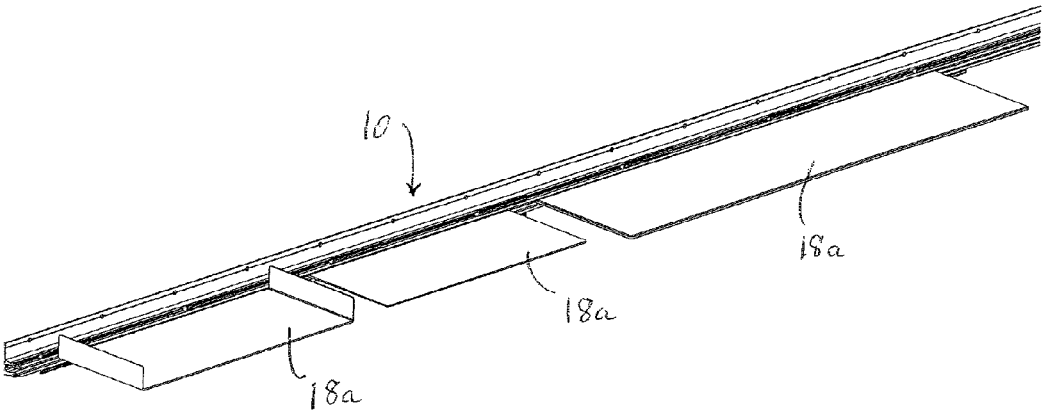
FIG. 25 is a perspective front view of a suspension device according to another embodiment with a variety of shelves as the plug-in elements.

FIG. 9 (see also FIG. 19 for a front view) illustrates an MDF installation, in which the upper and lower edge faces 76 of panels 14*a* are machined to create a rectangular channel 78 extending the length of the panel (best shown in the fragmentary enlargements of FIGS. 10 and 11). The profile rail section 20 includes, on the upper surface of the upper arm 22 and the lower surface of the lower arm 24, a profiled section 80 including recess or channel a square-section 82 that extends the length of the profile rail section 20. A series of inserts 84, of approximately 100 mm in length, are positioned in the profiled section 80 such that ribs 86 of the inserts 84 seat in the respective channels 82. The insert 84 further includes an upward I-section rib 88 that is received into machined channel 78, interconnecting the panels 14*a* to the profile rail sections 20. As the MDF panels 14*a* are fully finished when installed, fasteners cannot be used to affix the wall panels without marring the finished surface. The inserts 84 allow for the panels to be retained securely. Inserts 84 may be spaced apart such that, for example, there is one every 300 mm along the length of the profile rail section 20.

Different thicknesses of panels 14*a* may be provided, as shown respectively in FIGS. 10 and 11: in FIG. 10 the rear of the panel lies further back along the upper surface of the upper arm 22.

Reverting to FIG. 9, affixed to the rear of the panel 14*a* is a hanging bracket 90, with an undercut oblique bottom edge 91. A corresponding hanging bracket 92 of similar but inverted cross-section 10 is affixed to the permanent wall 74: the panel brackets 90 slot over the wall brackets 92 to hold the panels 14*a* in position. Brackets 90, 92 may be in pairs spaced along the wall and panel or may constitute matching longitudinally extending ribs. Progressive installation is achieved by affixing the lowermost wall bracket 92 to the permanent wall 74, then hanging the lowermost wall panel 14*a* with bracket 90 before slotting in the lowermost profile rail section 20 with inserts 84. The profile rail section 20 is screwed to the permanent wall 74 through apertures 72. Another panel 14*a* is slotted over upper insert 84, utilising or not utilising further hanging brackets. Another profile rail section 20 is then screwed to the wall 74 and the display wall is progressively built upwards.

Figure 12:
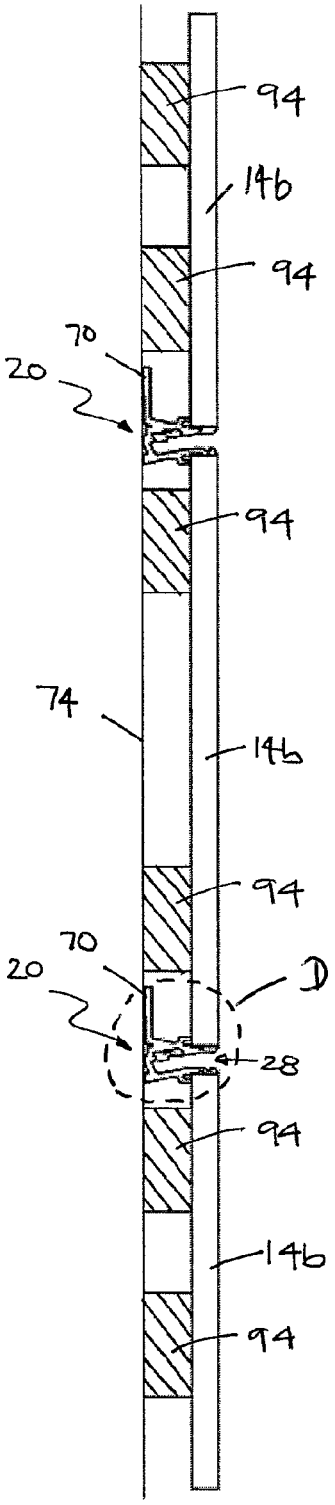
FIG. 12 is a side end view of an alternative merchandising display system.
Figure 13:
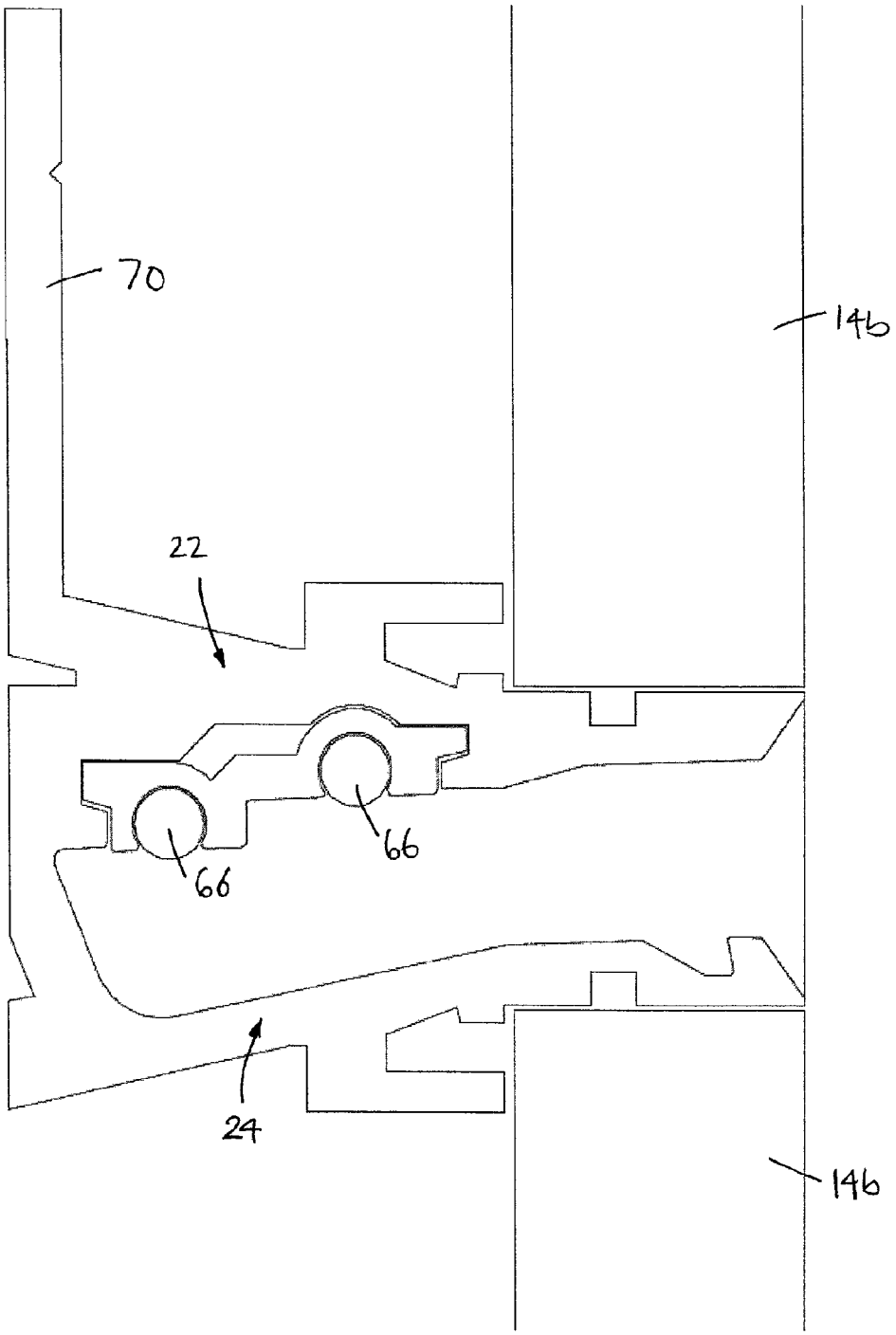
FIG. 13 is an enlargement of the region D in FIG. 12.

In the embodiment shown in FIGS. 12 and 13, plaster board panels 14*b* are used. As plaster board cannot be machined, and does not have a final finish, the inserts 84 are omitted and the plaster board panels 14*b* sit against the upper surface of the upper arm 22 and lower surface of lower arm 24. The plaster board can be screwed or nailed from the front to compensating spacers or latching 94 that sit between the permanent wall 74 and the plaster board panels 14*b*. The plaster board panels 14*b* are then plastered and painted to provide the final finish.

Figure 7:
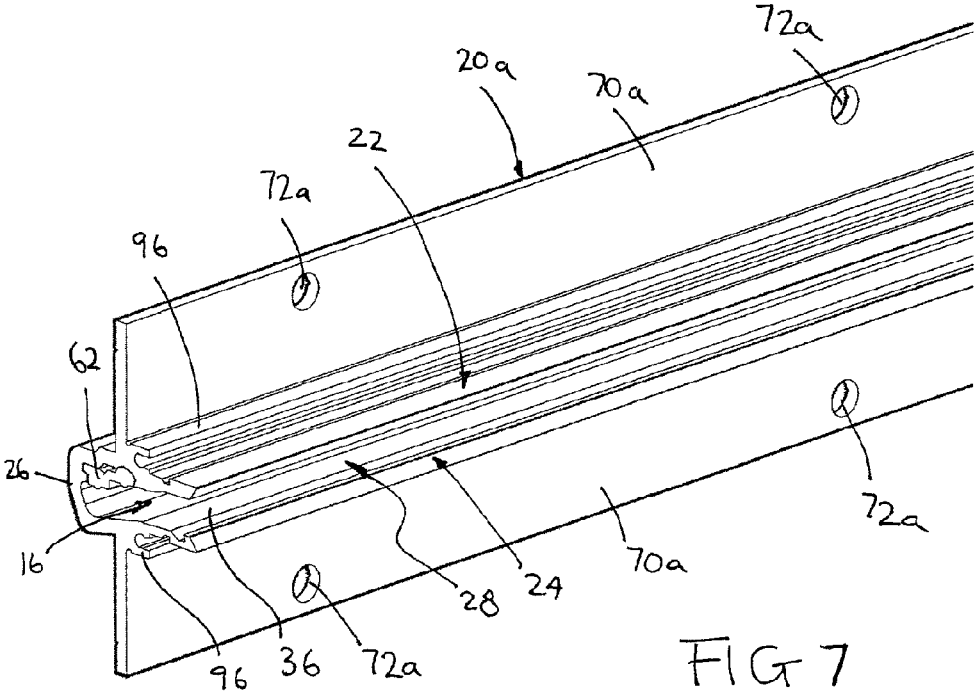
FIG. 7 is a perspective front view of a suspension device according to a third embodiment of the invention.
Figure 14:
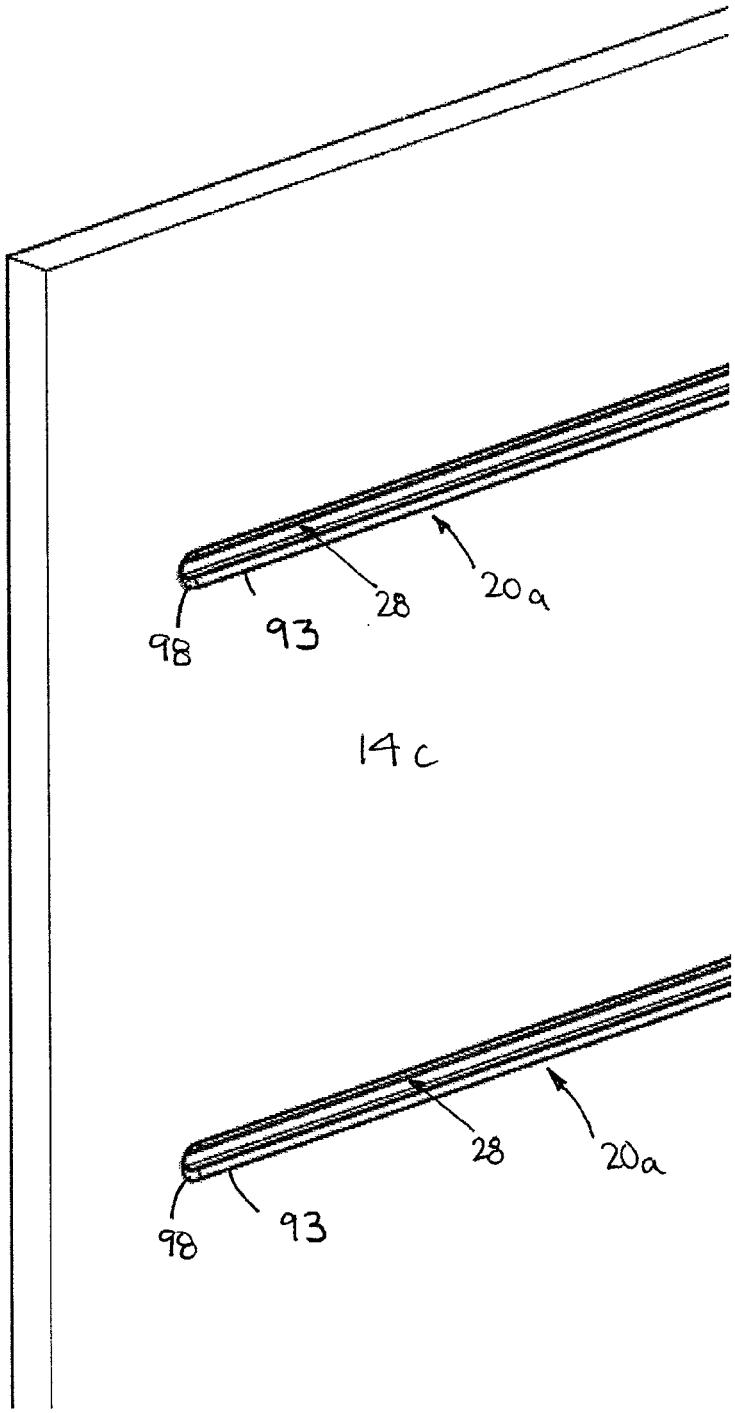
FIG. 14 is a perspective view of a merchandising display system including two suspension devices according to the third embodiment.
Figure 15:
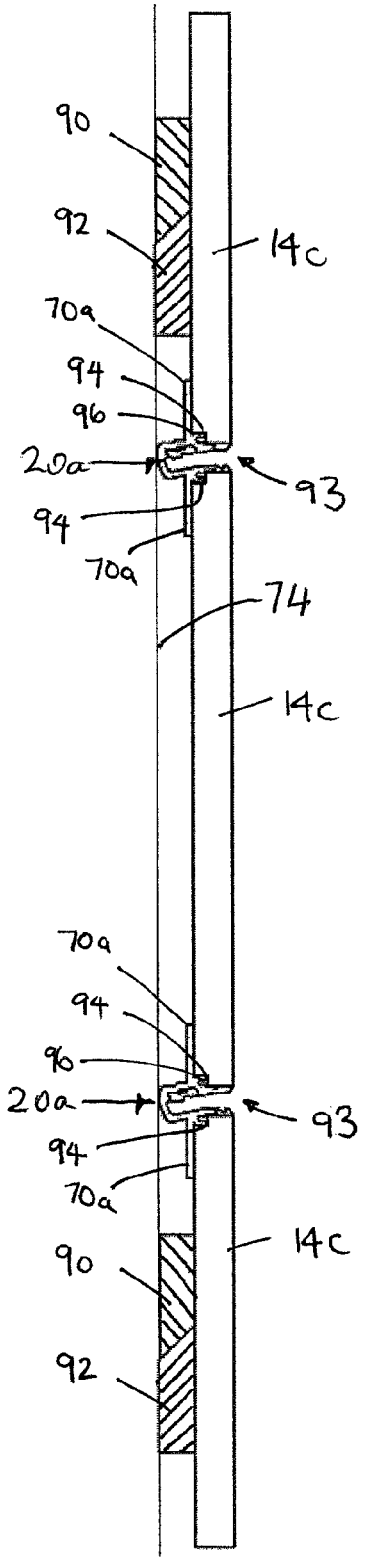
FIG. 15 is a side cross-sectional view of the merchandising display system of FIG. 14.
Figure 16:
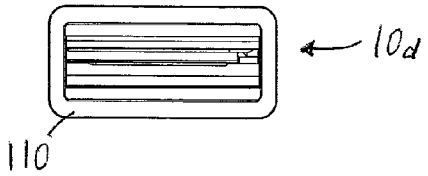
FIG. 16 is a front view of a holder utilising a suspension device according to a fourth embodiment of the invention.
Figure 17:
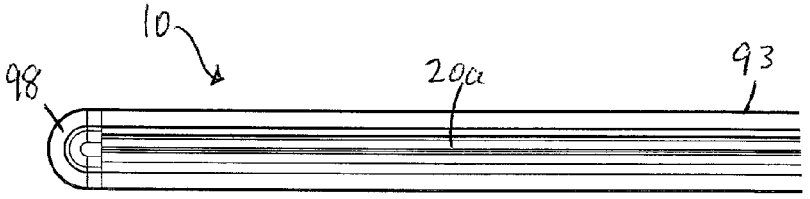
FIG. 17 is a front view of a merchandising display using the suspension device of FIG. 7.

Turning to the alternative profile rail section 20*a*, as shown in FIGS. 7, 14 and 15, co-planar upper and lower projecting flanges 70*a* are provided, extending from the upper and lower arms 22, 24 forward of the rear wall 26, such that they project from an intermediate position along the arms 22, 24. The front section of the arms forward of the flanges 70*a* are of a length corresponding to the depth of a panel 14*c* to which they are affixed in the manner shown in FIGS. 14 and 15. Rather than affixing to the permanent wall 74, the profile rail section 20*a* is affixed to the rear of the panels 14*c* through apertures 72*a*. This profile rail section 20*a* is used for what is referred to as a floating installation, in which a single panel 14*c* used. A series of slots 93 having defined ends are cut into the panel 14*c* as shown in FIG. 14. The profile rail section 20*a* is inserted from the rear of the panel 14*c*, with the flanges 70*a* abutted against the rear surface of the panel. The slots 93 can include a recessed shoulder 94 against which legs 96 abut, see FIG. 14. The entire wall panel 14*c*, with rearwardly inserted profile rail sections 20*a*, is then affixed to the permanent wall 74 using pairs of inter-engaging hanging brackets 90, 92 as earlier described. End caps 98 (FIG. 14) are inserted from the front to provide a rounded appearance to the front of the slots 93, as shown in FIG. 17.

As shown in FIGS. 21 to 25, a variety of different plug in elements 18 may be accommodated in the passages 16, including shelves 18*a* and various arms 18*b*. Arms 18*b* may be mounted onto insertion brackets 19 having a generally rectangular plate like section, such that once inserted they are held in a cantilevered manner, whereby downward weight further engages the connection and a slight upward lifting motion is required before the plug in elements 18 can be withdrawn.

Figure 18:
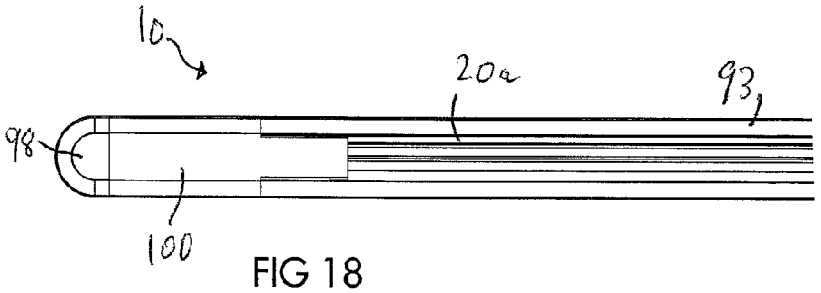
FIG. 18 is a front view of a merchandising display using a suspension device according to a fifth embodiment.
Figure 26:
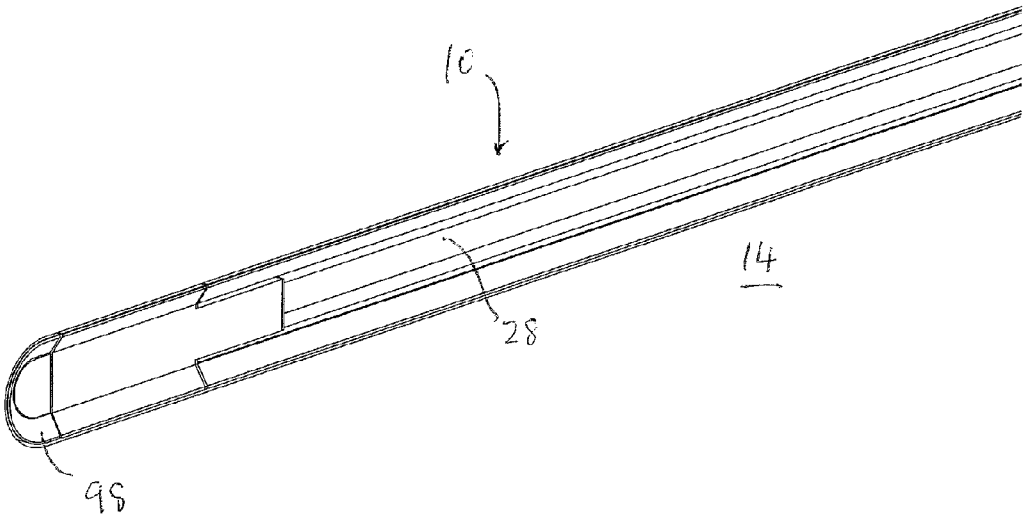
FIG. 26 is a front perspective view of a floating installation.
Figure 27:
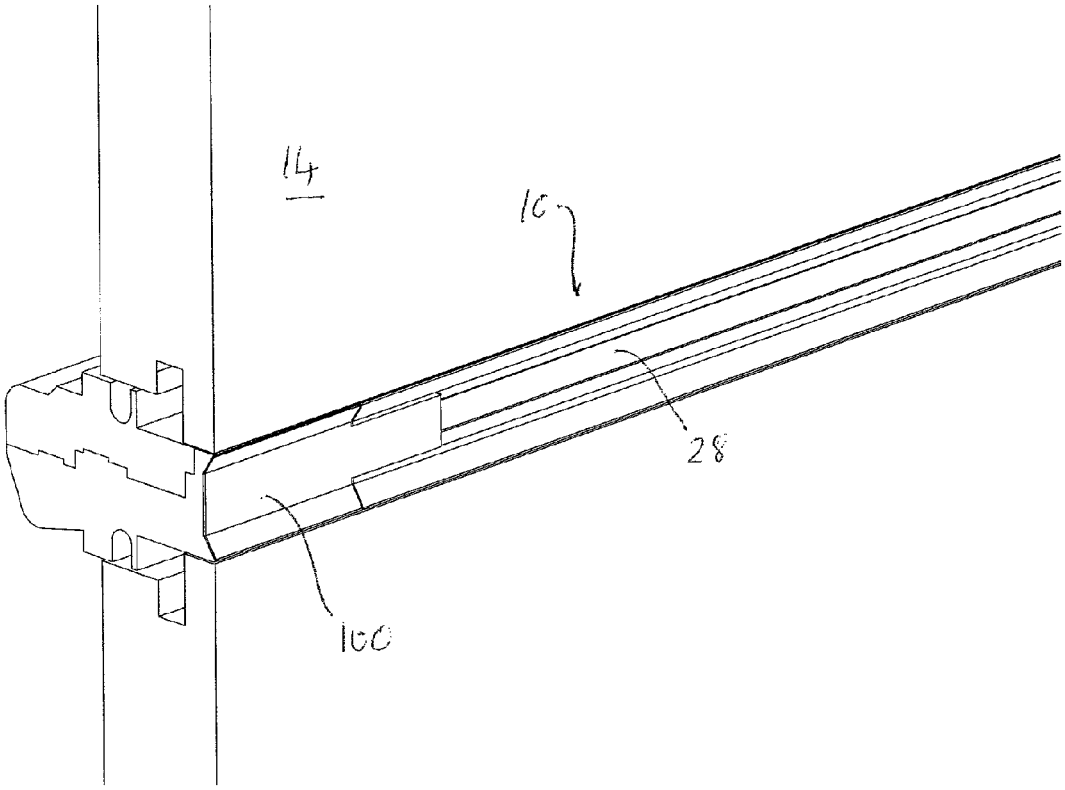
FIG. 27 is a front perspective view of a continuous installation.
Figure 28:
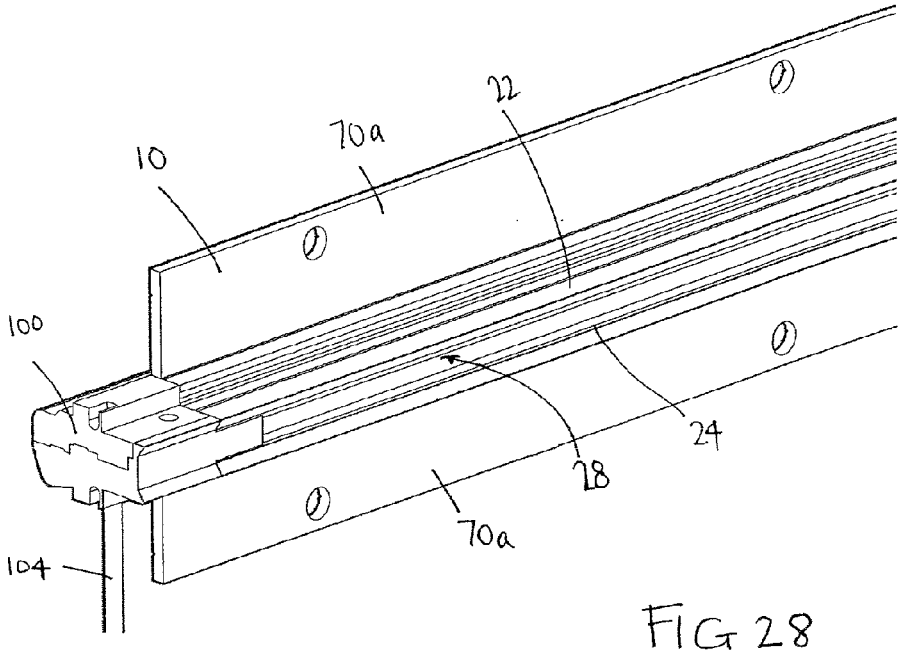
FIG. 28 is an end perspective view of a suspension device with an attached power adapter.
Figure 29:
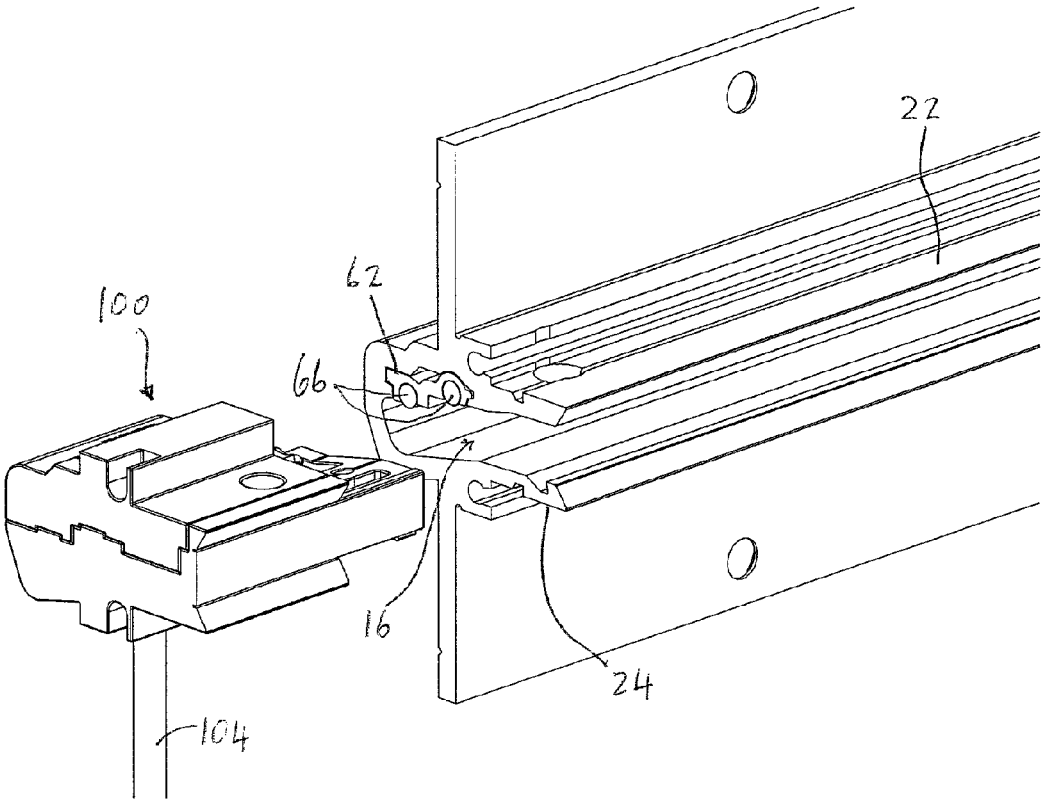
FIG. 29 is an end perspective view of the suspension device of FIG. 28 with the power adapter disengaged.
Figure 30:
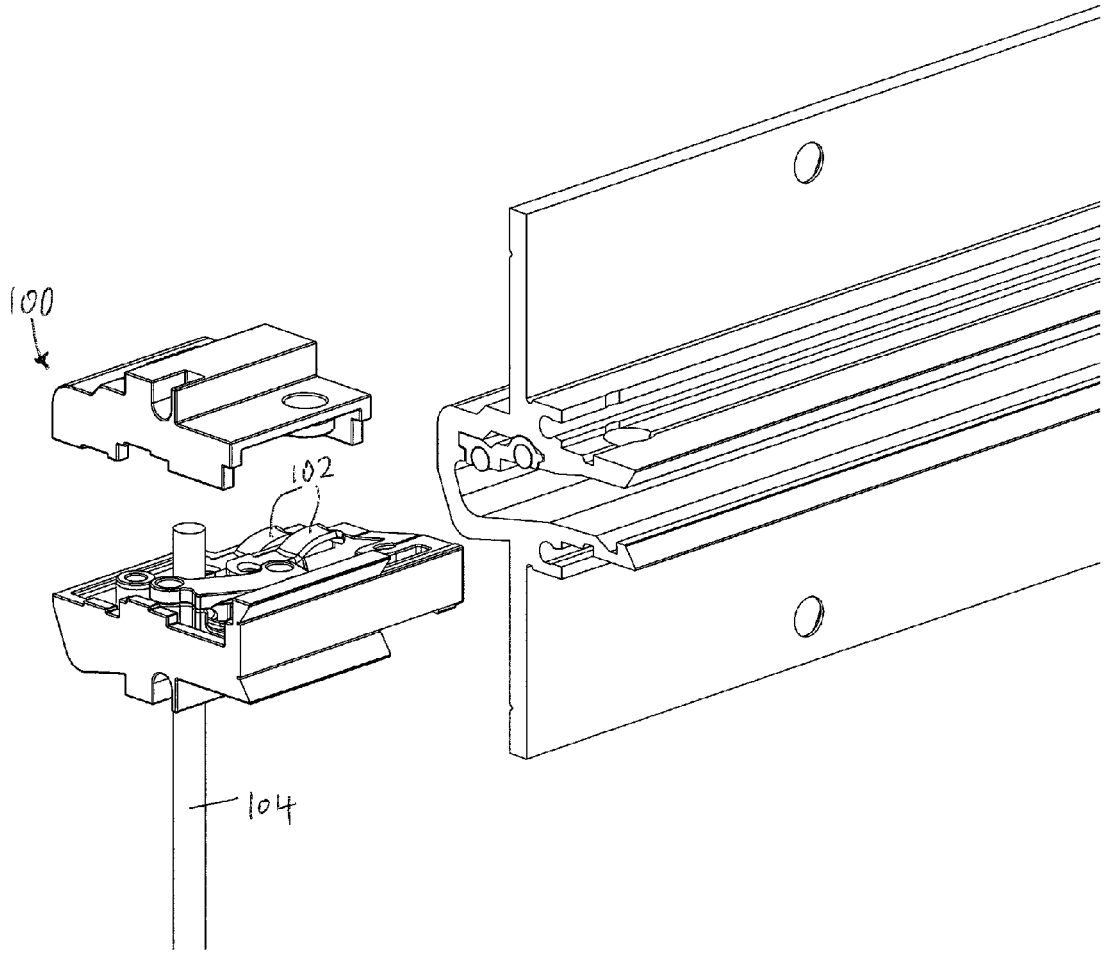
FIG. 30 is an end perspective view corresponding to FIG. 29 but with the disengaged power adapter shown with the top removed.

As discussed above, the profile rail sections 20 may be electrified by the insertion of two copper wires 66 in the ceiling 30 of the passage 16, located at the upper contact surfaces 40, 42. Power adapters 100 (FIGS. 18, 20 and 26 to 32) are used that slot into the ends of the profile rail sections 20, having two spring loaded contacts 102 (FIGS. 30 and 32) for contacting the ends of the two copper wires 66. A power cord 104 is provided that can be plugged back into mains power. End caps 98 (FIGS. 18 and 26) are utilised to close the ends of the profile rails.

Figure 31:
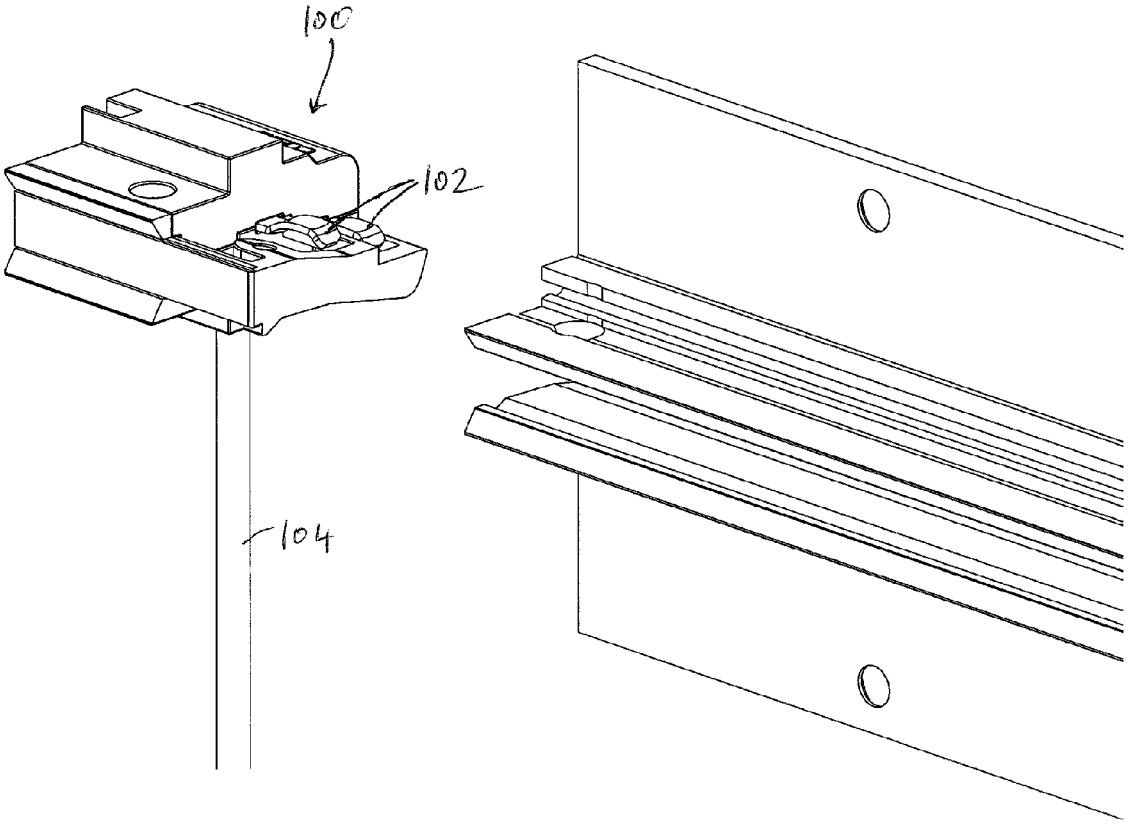
FIG. 31 is a perspective view of the power adapter shown in FIG. 29 from the opposite end.
Figure 32:
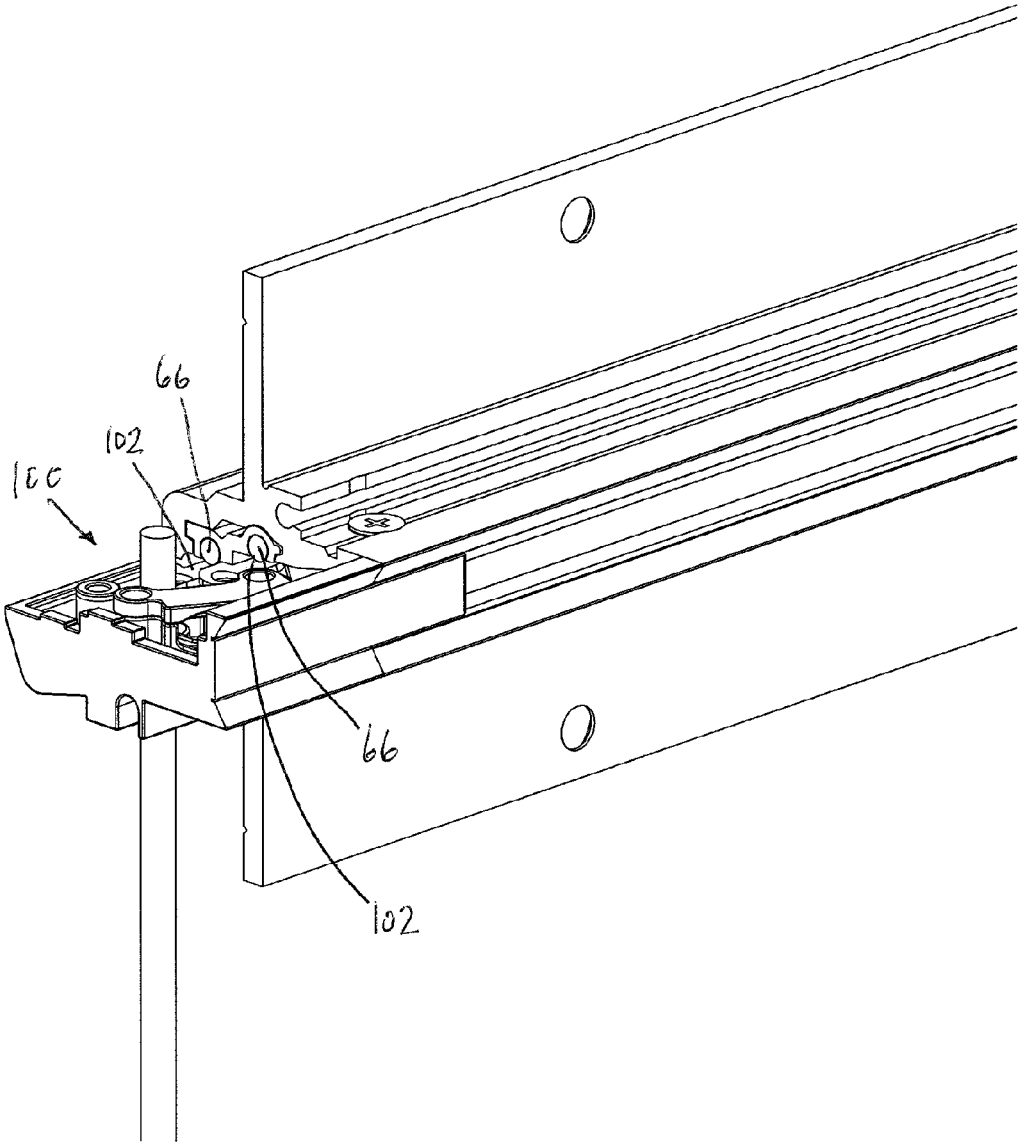
FIG. 32 is a perspective view corresponding to FIG. 30 with the power adapter engaged.
Figure 33:
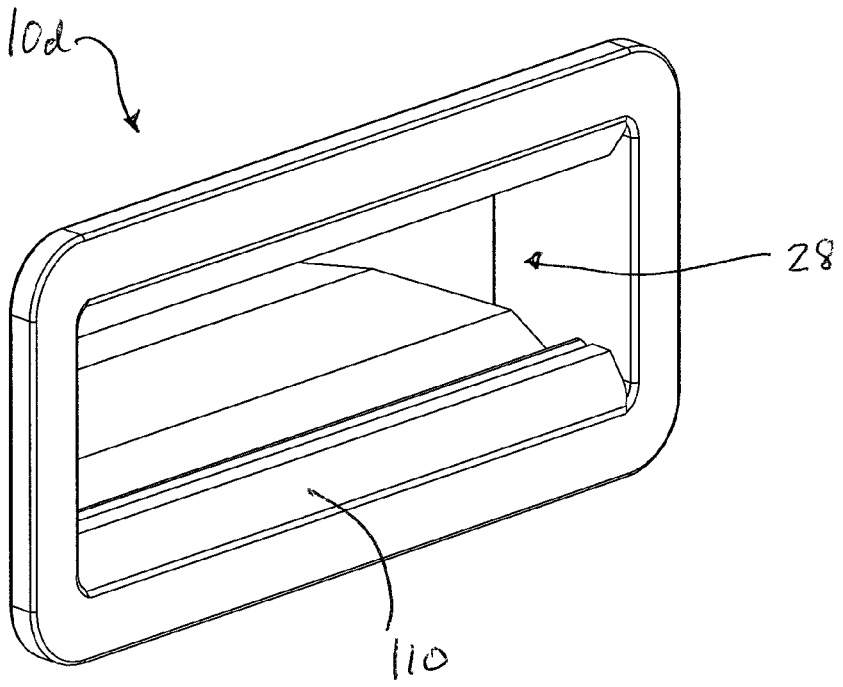
FIG. 33 is a perspective view of a holder installed in a wall surface.
Figure 34:
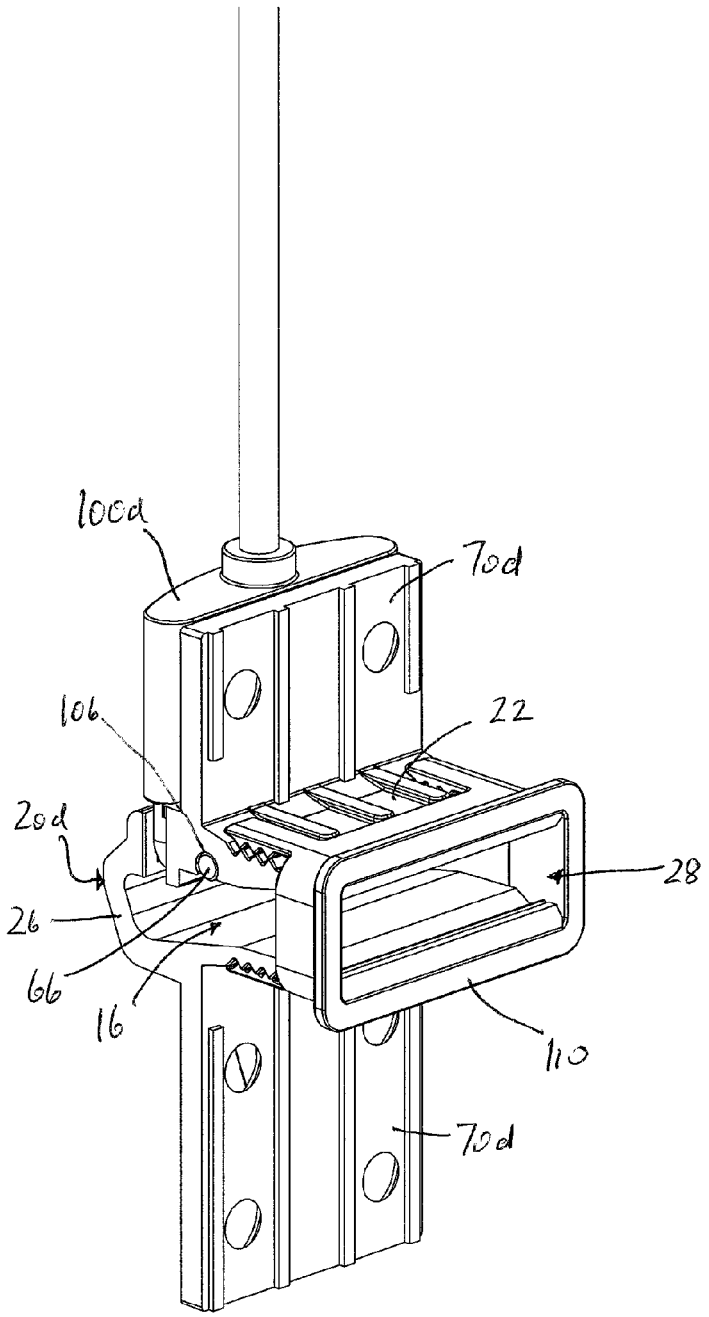
FIG. 34 is a sectioned perspective view of the in situ holder of FIG. 33 utilising a suspension device according to the fourth embodiment.
Figure 35:
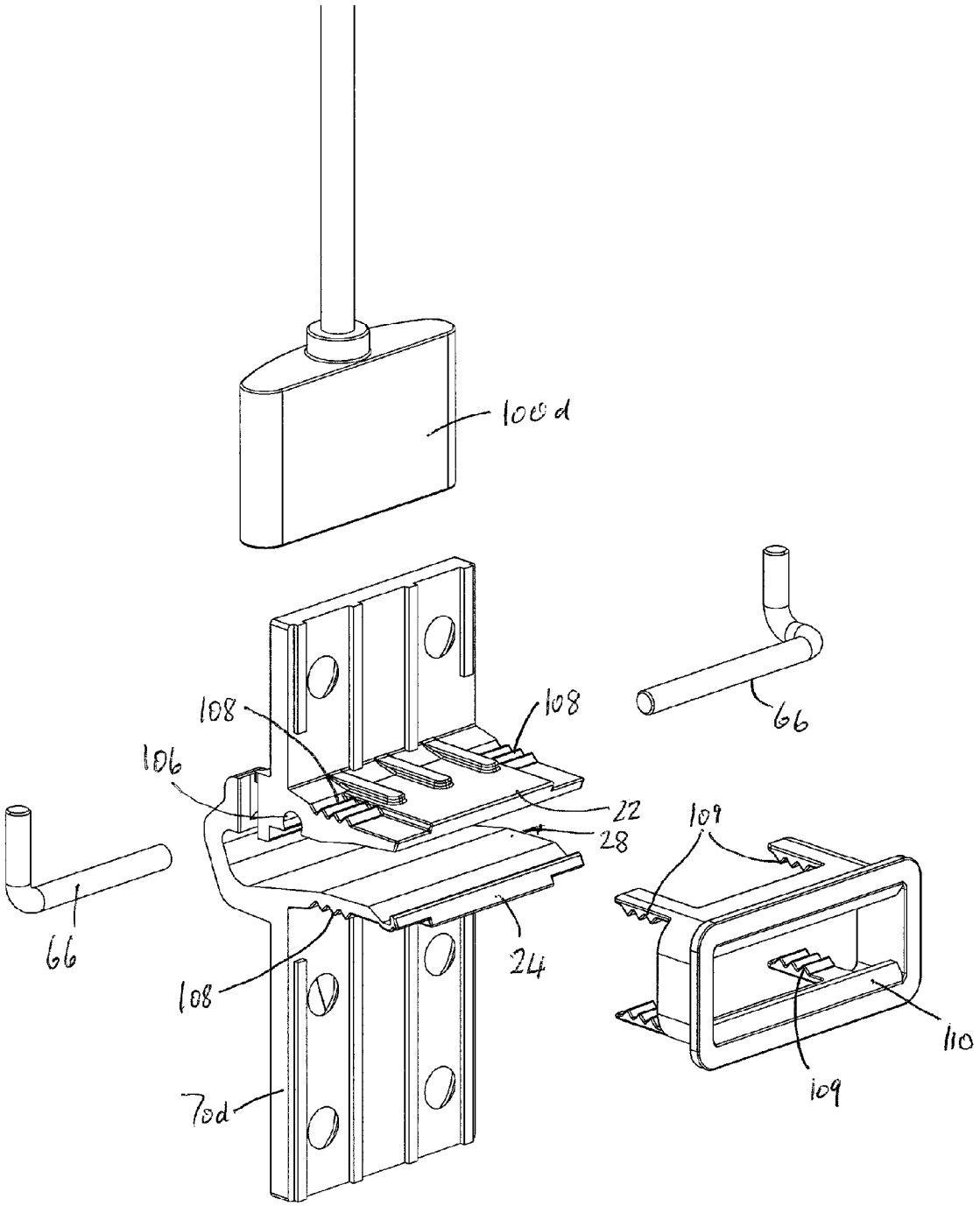
FIG. 35 is a front exploded view of the in situ holder of FIG. 34.
Figure 36:
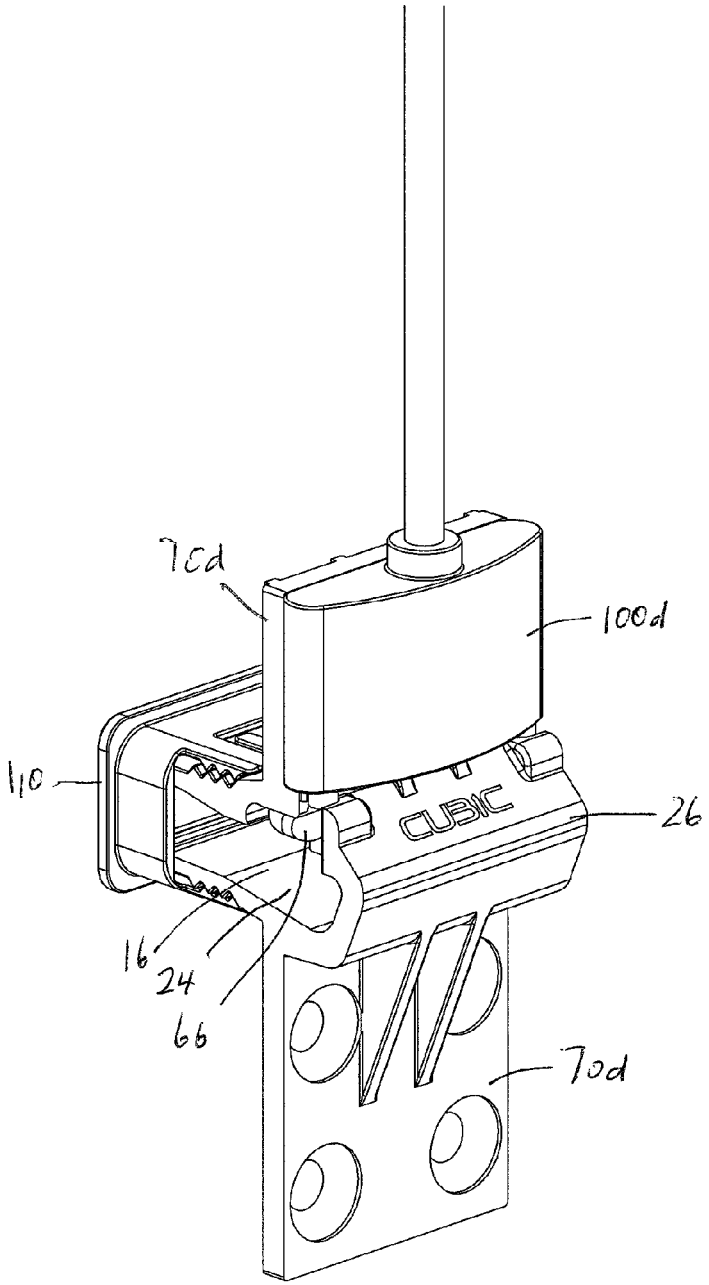
FIG. 36 is a rear view of the in situ holder of FIG. 34.
Figure 37:
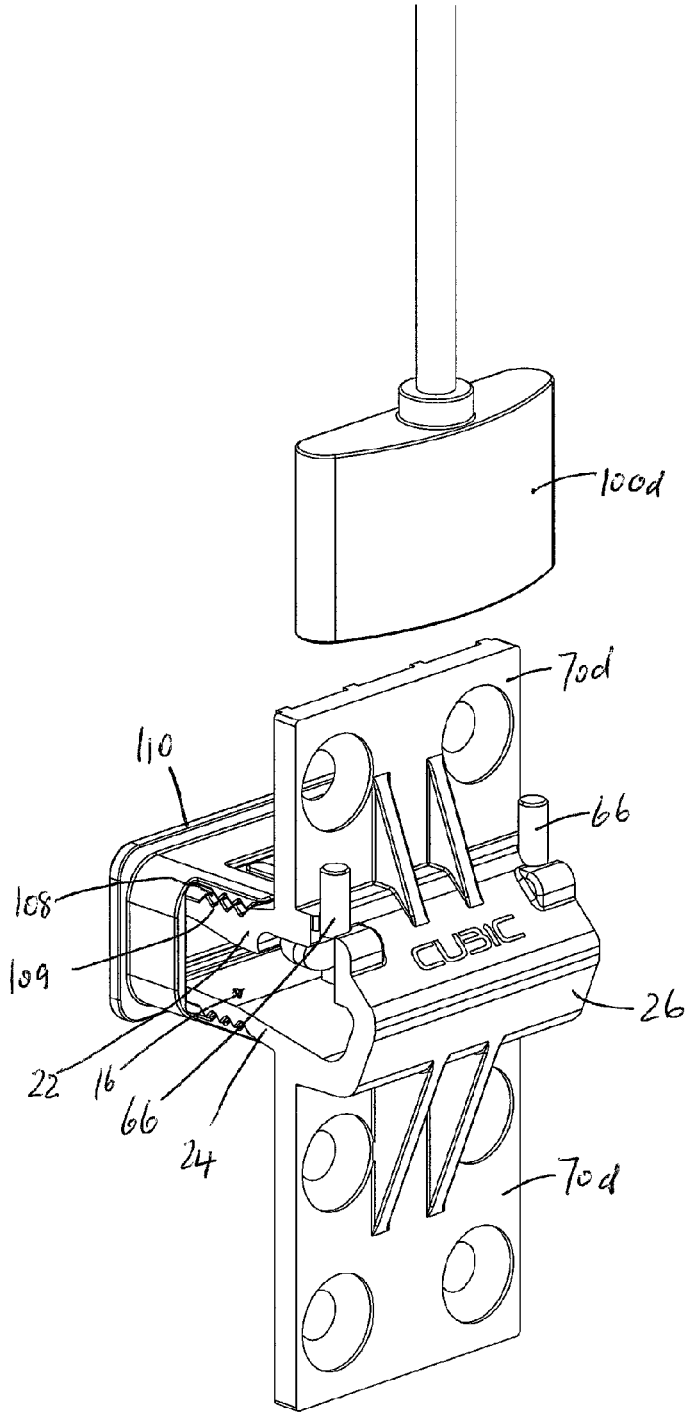
FIG. 37 is a view similar to FIG. 36 with the adapter disconnected.
Figure 38:
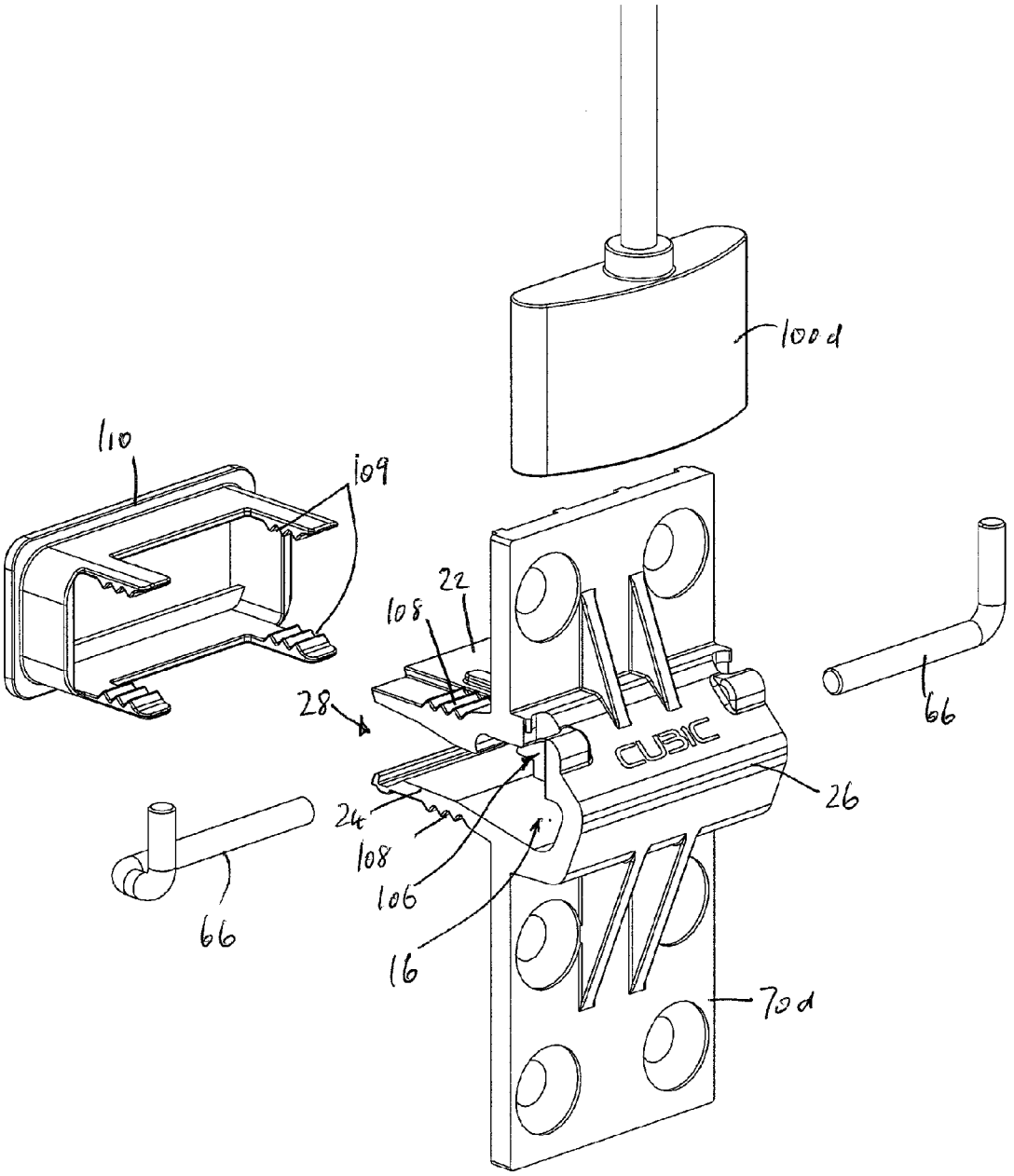
FIG. 38 is a rear exploded view of the in situ holder of FIG. 34.

An alternative suspension device 10*d* shown in FIGS. 16 and 33 to 38 incorporates a rail section 20*d*, having a substantially short length, to form what is referred to as a socket or holder, typically for holding a single plug in element 18, such as an arm. Similar to the floating suspension device shown in FIGS. 7, 14 and 15, the rail section 20*d* includes two opposing upwardly and downwardly projecting flanges 70*d*. In the embodiment illustrated, the lower flange extends further than the upper flange, however any arrangement would be suitable. This port 20*d* is made from plastic, by injection moulding, and therefore is not electrically conducting. Channels 106 are provided for housing the copper wires 66*d*. The ends 67 of the copper wires 66*d* are upwardly bent, see FIG. 35, such that they can both plug into an adapter 100*d* located above the profile rail 20*d* behind the upper flange 70*d*, as shown in FIGS. 31 and 32. If a series of suspension device sockets 10*d* are provided in a wall display, a connected adapter arrangement may be provided (not shown). The forward outer surfaces of the upper and lower arms 22, 24 include serrated sections 108 that allow for the mounting of a front cap 110 with corresponding serrated sections 109 from the front of the wall panel 14*d* to provide a surround about the aperture or slot created.

FIG. 39 shows a metal shelf 18*a* inserted into a suspension device 10, whereby the stepped arrangement and relative locations of the copper wires prevent the metal shelf 18*a* from contacting the two copper wires 66 simultaneously, as simultaneous contact would result in short circuiting. Shelves could be made from any material, such as wood, glass, metal, plastic, and may or may not be conductive or include light emitting devices. Nonconductive shelves and arms can be inserted into an electrified profile rail in the same manner as the nonelectrified profile rails.

Figure 43:
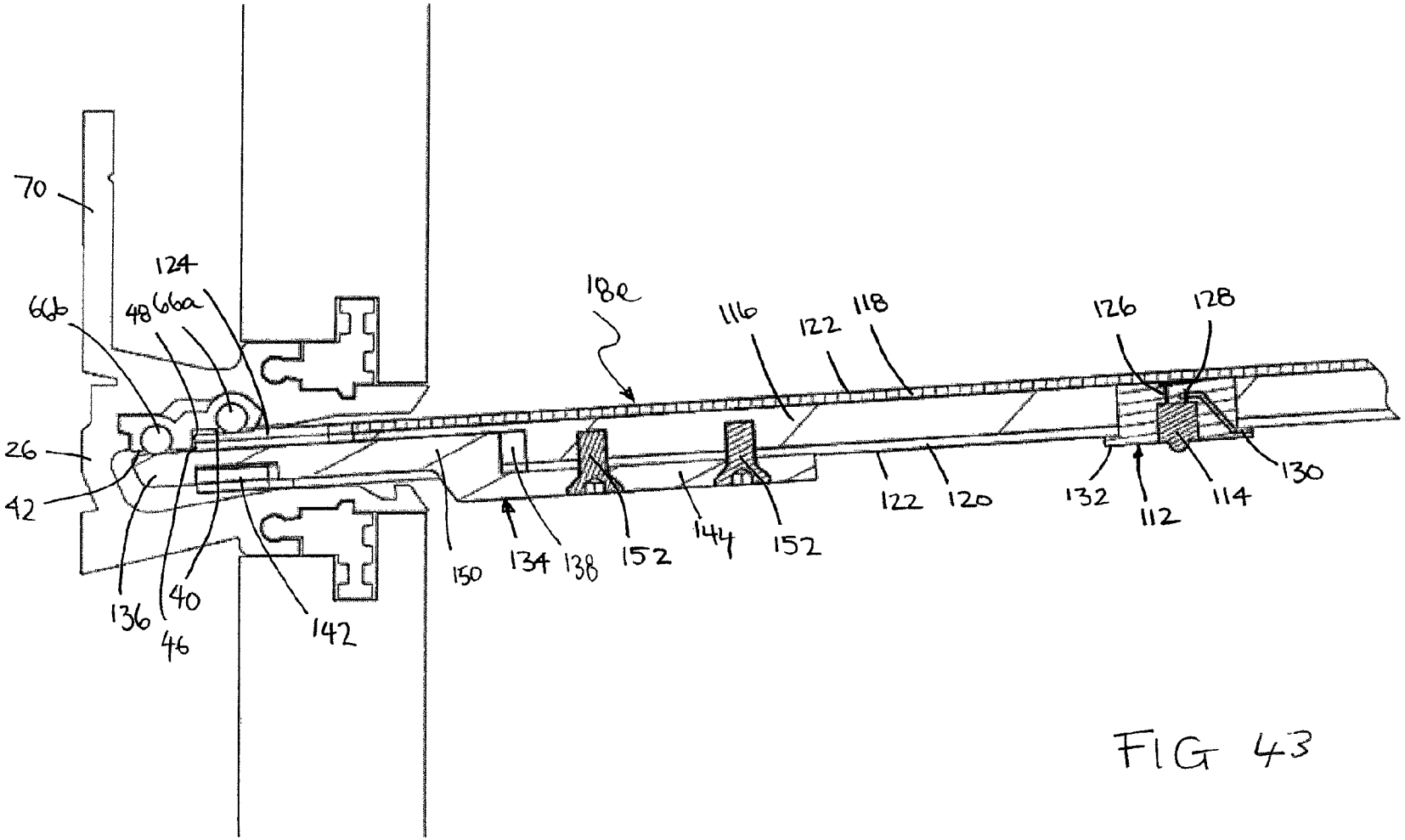
FIG. 43 is an end view corresponding to FIGS. 39, 40 and 42 with a fourth plug in element of the third thickness, incorporating a bracket element.
Figure 44:
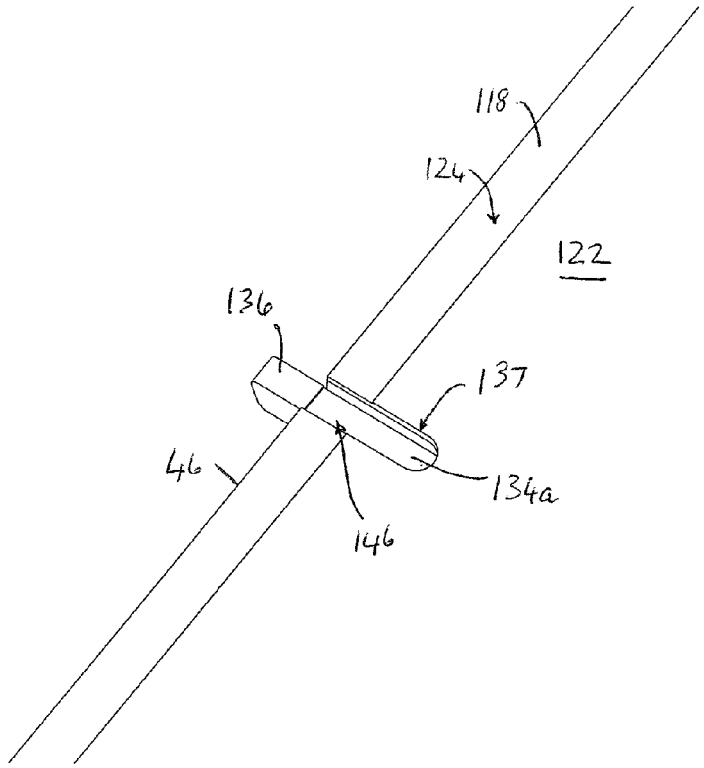
FIG. 44 is a top perspective view of the rear of the shelf of FIG. 43.
Figure 45:
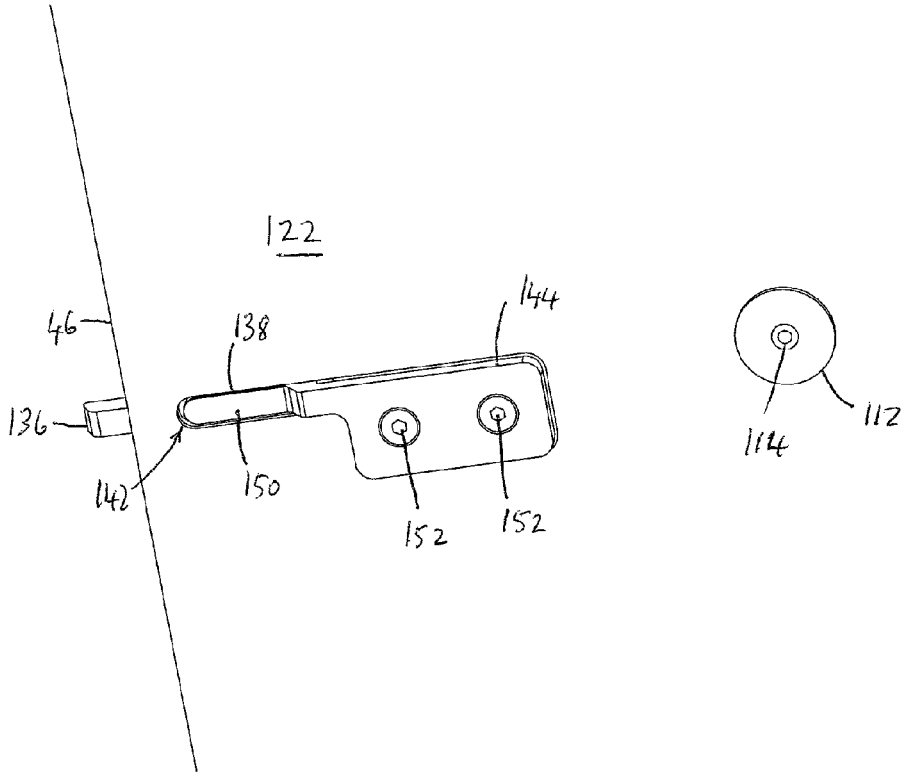
FIG. 45 is a bottom perspective view of the rear of the shelf of FIG. 43.
Figure 46:
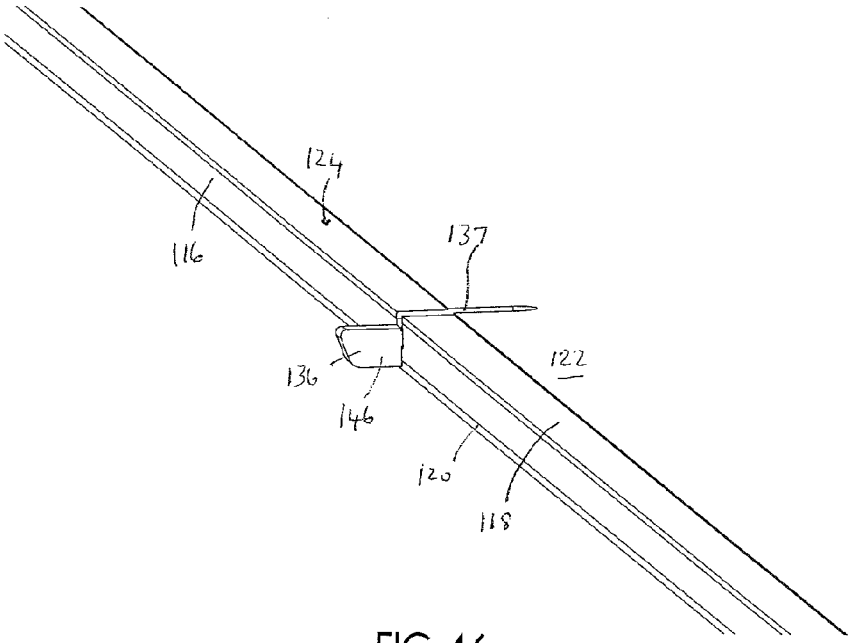
FIG. 46 is a rear perspective view of the rear of the shelf of FIG. 43.
Figure 47:
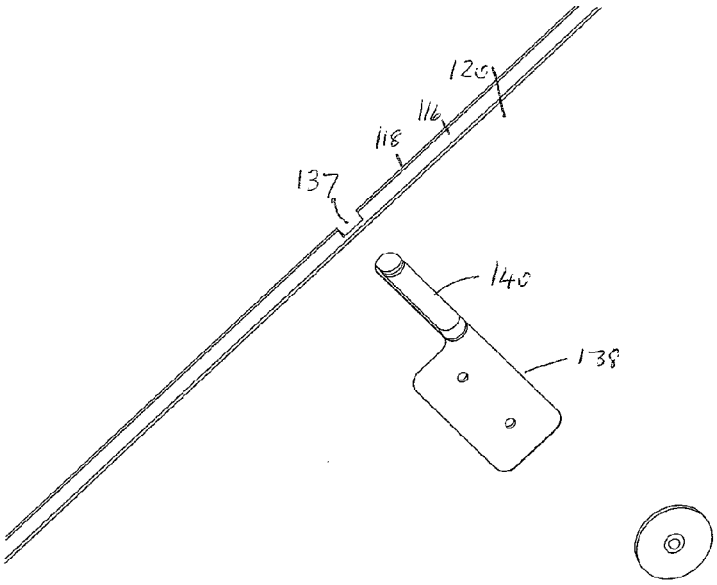
FIG. 47 is a bottom view of the shelf without bracket.
Figure 48:
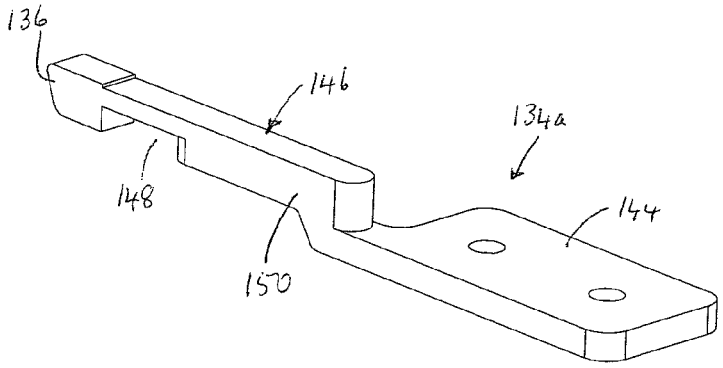
FIG. 48 is a perspective view of the bracket of FIG. 43.
Figure 49:
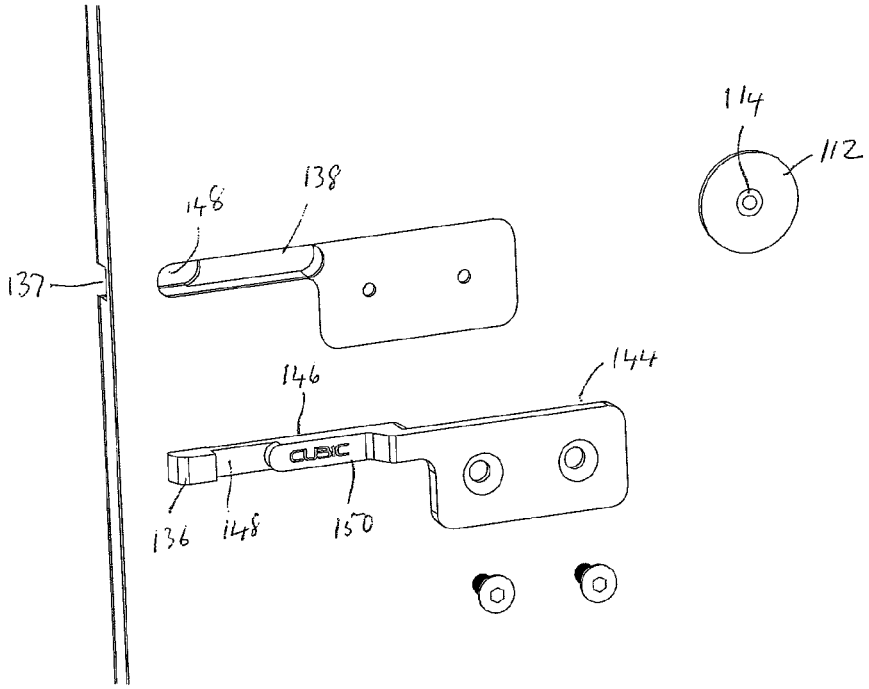
FIGS. 49 and 50 show the installation of the bracket into the shelf of FIG. 43.

An alternative shelf 18*e*, illustrated in FIG. 43, includes a plurality of embedded light emitting devices 112, each containing a diode 114. The shelf 18*e* is a laminate construction, including a core layer 116 of electrically insulating material, such as polyethylene. The core layer 116 is sandwiched between two layers of electrically conductive material, such as thin aluminium sheets 118, 120. This construction is known as an Aluminium Composite Panel, and is available under the trade mark Dibond™. The aluminium sheets 118, 120 are coated with a nonconductive material, such as a polyester coating 122, such that the surface of the shelf 18*e* is not electrified. Placing a standard Dibond™ shelf into the electrified profile rail 20*e* will not result in illumination of the diodes 114. As best shown in FIG. 44, a section of the coating 122 is machined away along the rear upper surface of the shelf to expose a strip 124 of the upper aluminium sheet 118. When the shelf 18*e* is inserted into the passage 16, the strip 124 contacts the front copper wire 66*a* at first contact surface 40. The rear edge 46 abuts against shoulder 48 preventing further insertion. A positive terminal pin 126 extends from the diode and is connected to the upper aluminium layer 118. A negative terminal pin 128 is connected via contact 130 with the lower aluminium sheet 120. The light emitting devices 112 include a housing with a lip 132 that sits against the polyester coating 122 enclosing the contact 130 and aluminium layer 120.

Electrical current is conveyed to the lower aluminium sheet 120 from the rearmost copper wire 66*b* at second contact surface 42 via a bracket 134 made from electrically conductive material. The bracket 134 can take a variety of forms, some of which will be described below. In each embodiment a rear end of the bracket provides an electrical contact 136 that extends further rearwardly than, or outwardly of, the rear edge 46 of the shelf 18*e*. The contact 136 is offset from the outer face of the upper sheet 120 that contacts wire 66*a* so that it contacts the rearmost copper wire 66*b*. A section of the shelf is machined to expose the lower aluminium sheet 120. A front section of the bracket 134 contacts the exposed lower aluminium sheet 120 and electrical current is conveyed from the rearmost copper wire 66*b* via the bracket 134 to the lower aluminium sheet 120 and subsequently via the contact 130 to the negative terminal pin 128, closing the circuit to light the diode 114.

Figure 50:
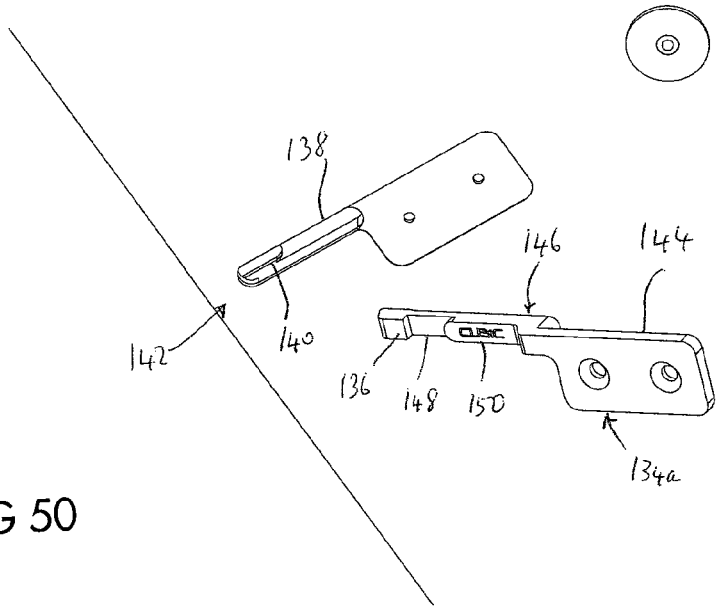
Figure 51:
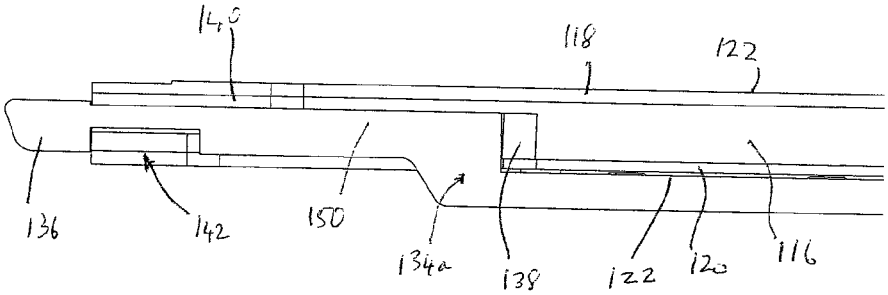
FIG. 51 is a cross-sectional side view of the shelf of FIG. 43.

A first bracket embodiment is shown in FIGS. 43 to 51. The shelf 18*e* is machined away using a router to create an opening 138 in the underside. An overlapping opening 137 of smaller size is machined away from the top side (this is best illustrated in FIG. 50). This creates an open ended slot 137 in the top surface and a closed slot 138 in the lower surface, with an overlapping section creating an aperture 140 with a bridge section 142. A bracket 134*a* is shown, which could be made from a non-conductive material, such as ABS (Acrylonitrile butadiene styrene), that has been electroplated with a conductive coating, such as chrome. The bracket 134*a* includes a front plate section 144 that provides structure support for the shelf and a rear arm 146 that includes a transverse cut out section 148. The rear arm 146 is inserted through the aperture 140 at an angle and is then lowered so that the cut out section 148 sits over the bridge 142 and the front section 150 of the arm 146 fits into the slot 138 and the rear end 136 projects out the rear of the shelf. The plate section 144 is affixed to the underside of the shelf using fasteners 152.

Figure 52:
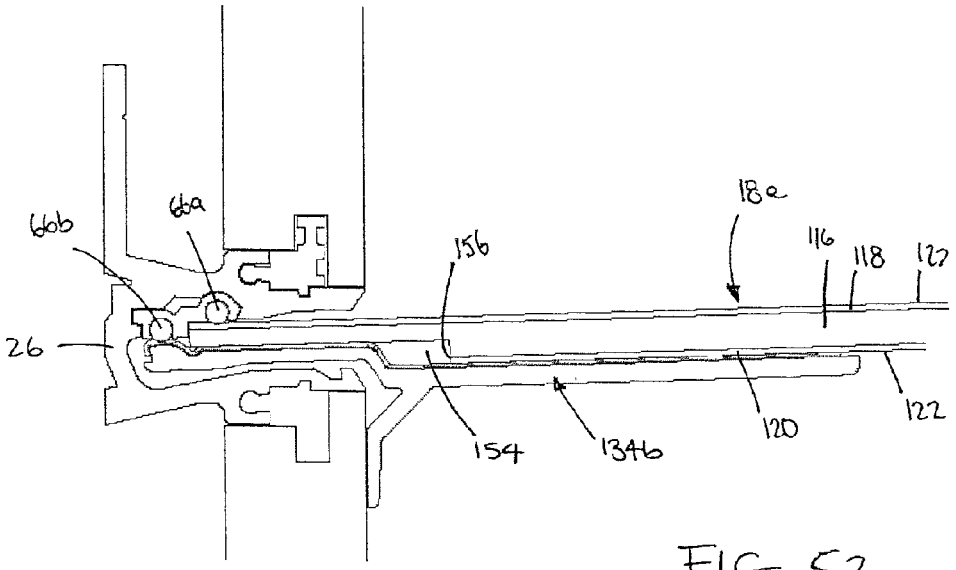
FIG. 52 is a cross-sectional side view of a shelf according to a second embodiment.
Figure 53:
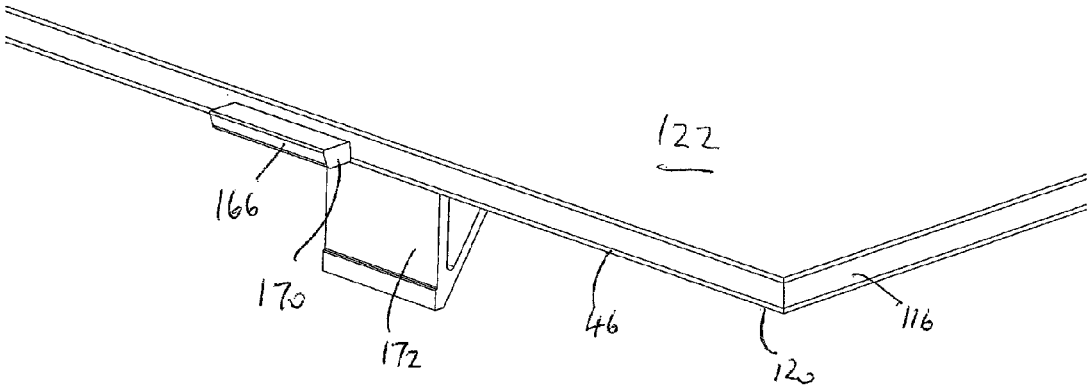
FIG. 53 is a rear view of the shelf of FIG. 52.
Figure 54:
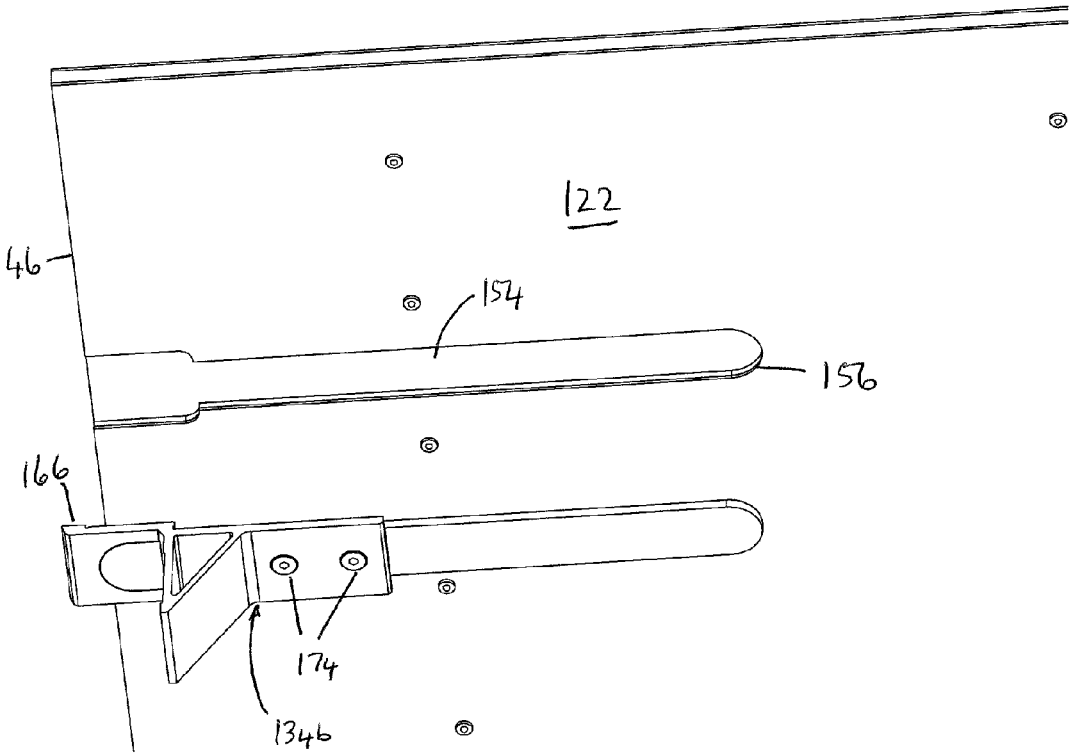
FIG. 54 is a bottom perspective view of a shelf with a bracket according to a third embodiment.
Figure 55:
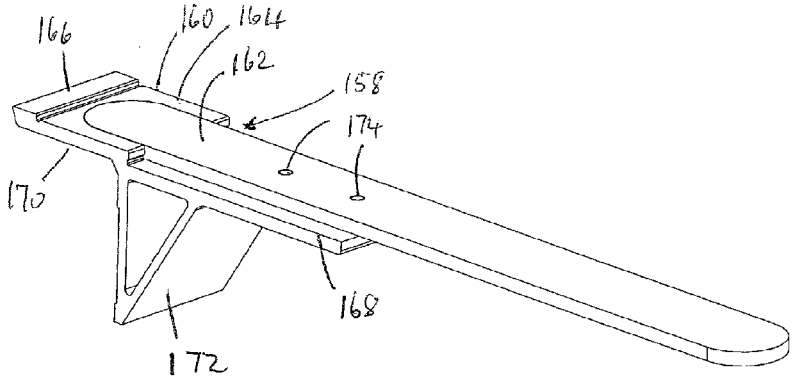
FIG. 55 is a perspective view of the bracket of FIG. 54.
Figure 56:
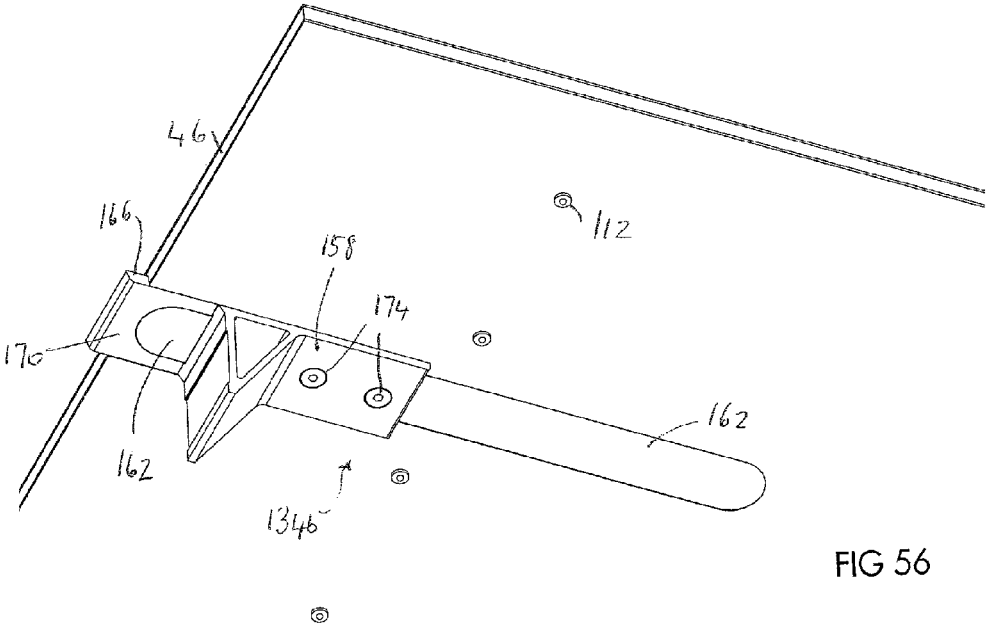
FIG. 56 is a bottom perspective view of the shelf of FIG. 54.
Figure 57:
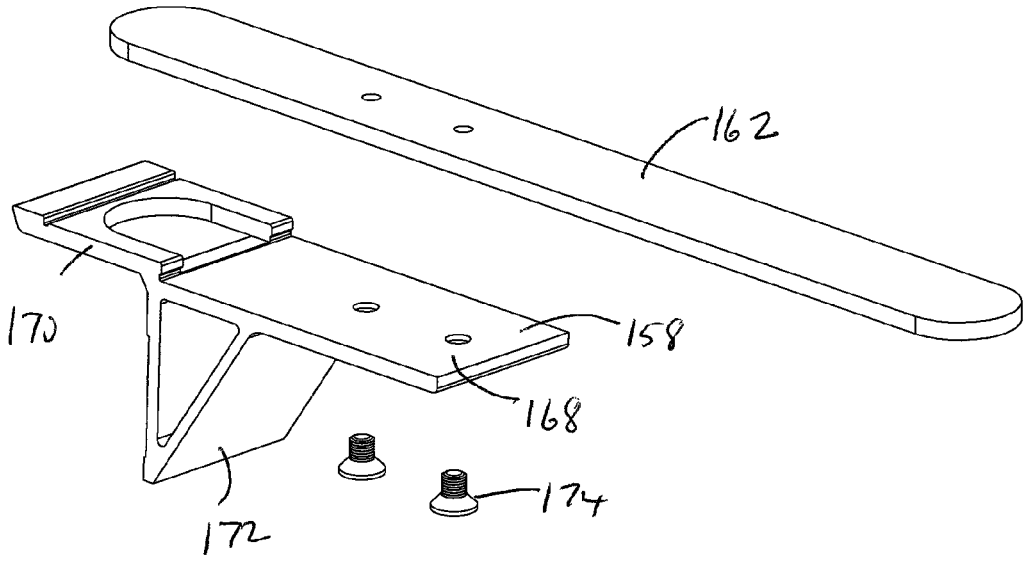
FIG. 57 is an exploded perspective view of the bracket of FIG. 54.

An alternative bracket 134*b* embodiment is shown in FIGS. 52 through 57. In this embodiment, only the underside of the shelf 18*e* is machined away to make a cut out section 154 with exposed section 156 of lower aluminium sheet 120. A bracing element 158 having a front planar section 168, a rear section 170 and a downwardly extending bracing leg 172, typically made out of aluminium, is covered with a thin conductive steel plate 160 bent to conform to the surface of bracing element 158. A stainless steel support 162 is fastened by screws 174 to the bracing element 158, clamping the steel plate 160 in between. The bracket 134*b* is glued to the cut out section 154, with the forward extending strips 164 of the plate 160 contacting with the exposed section 156 of the lower aluminium sheet 120. The rear of the bracket 134*b* includes an upwardly protruding strip 166 that extends past the rear edge 46 of the shelf. This strip 166 provides a contact that, as shown in FIG. 52 is stepped down, i.e. offset, from the upper surface of the shelf, such that it contacts the rearmost copper wire 66*b* at second contact surface 42.

As an alternative or additional to the light emitting devices, a USB charger (not shown) can be powered by the electrified profile rail. The USB charger plugs directly into the passage 16, and includes a housing that corresponds to the passage profile. The housing includes small wheels to enable the housing to slide along the length of the profile rail allowing positioning where appropriate. Alternatively the USB charger could be incorporated into a plug in element to connect to the Dibond™ shelf in a manner similar to the light emitting devices.

The present invention provide a highly adaptable suspension device for use as a horizontal display system. The profile rail is capable of accommodating two or more thicknesses of plug in elements and may be adapted to be electrified for the incorporation of lighting devices or chargers, or other suitable devices.

FIGS. 58 to 62 illustrate two optional additional features for use with the earlier described suspension devices or indeed with other forms of profile rail. Features that correspond to features of earlier embodiments are indicated by similar reference numerals preceded by 2.

Figure 58:
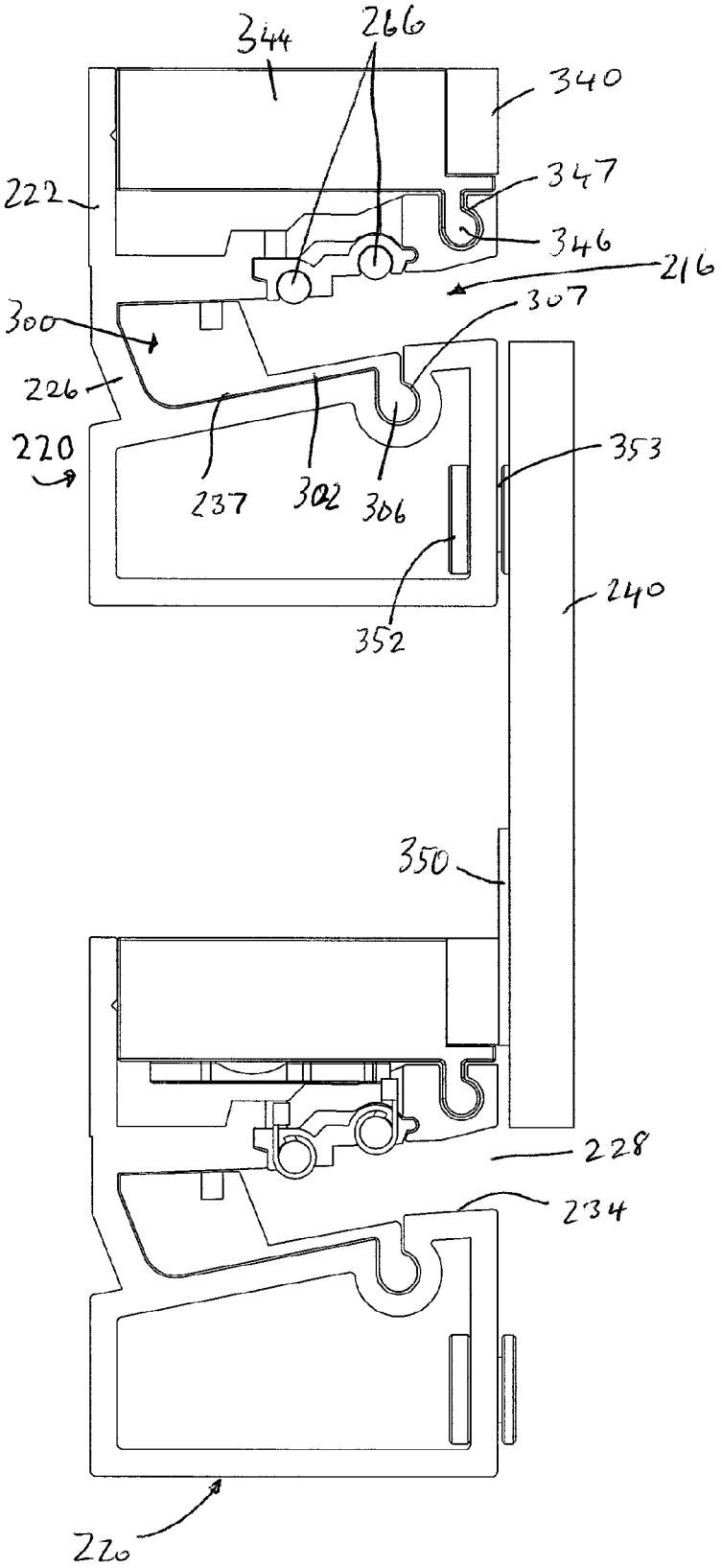
FIG. 58 is a vertical cross-sectional view of a pair of modified suspension devices/profile rails fitted with respective additional features that facilitate lateral locating of the plug in elements and easy attachment of front panels without separate fasteners or tools.
Figure 59:
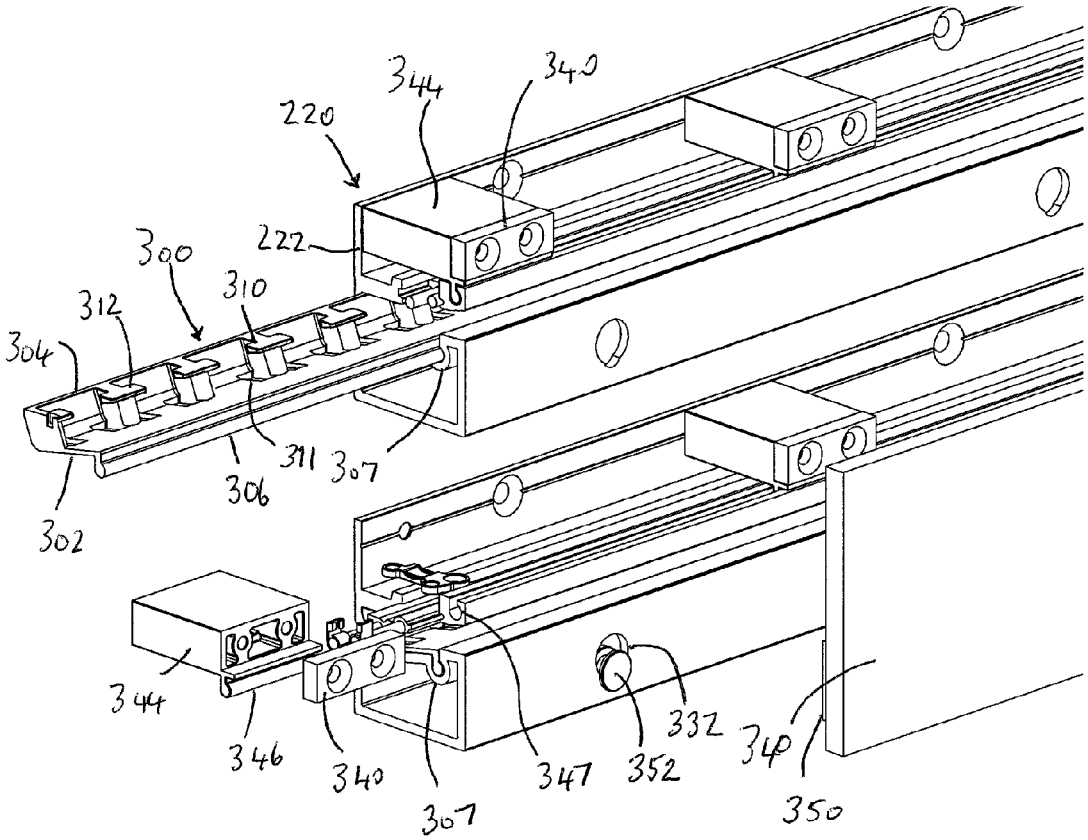
FIG. 59 is partly exploded 3D cutaway view of the arrangement of FIG. 58.
Figure 60:
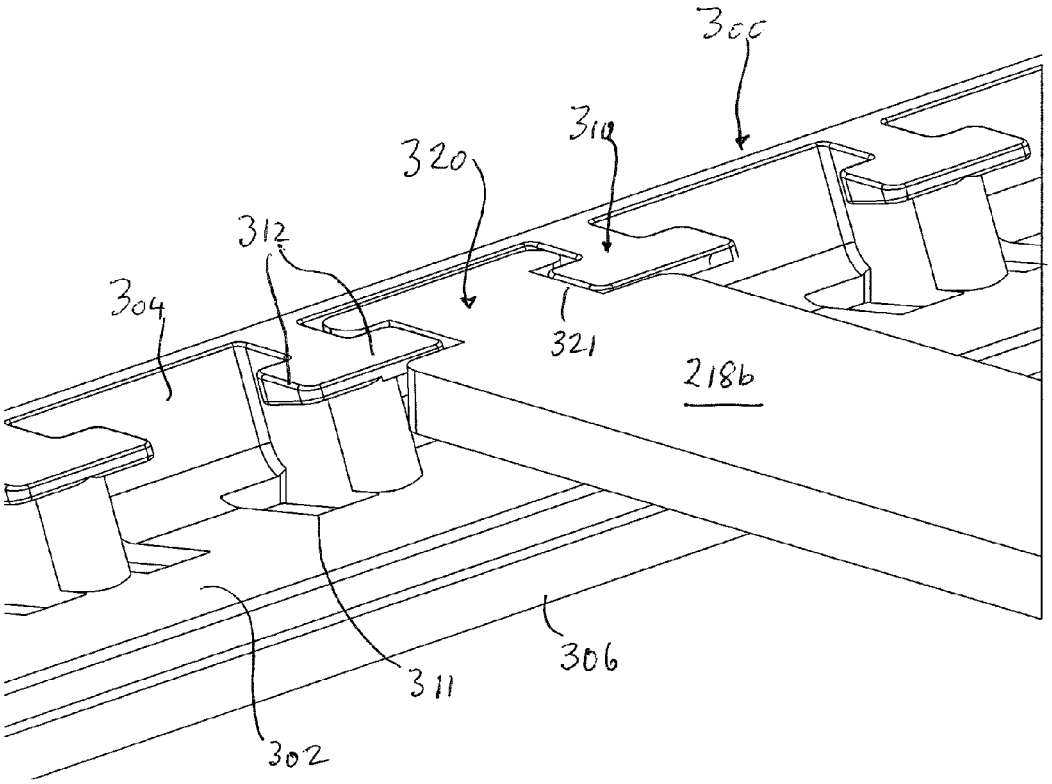
FIG. 60 is a fragmentary close up view of the interaction between a plugged in arm and a slide-in control element.
Figure 61:
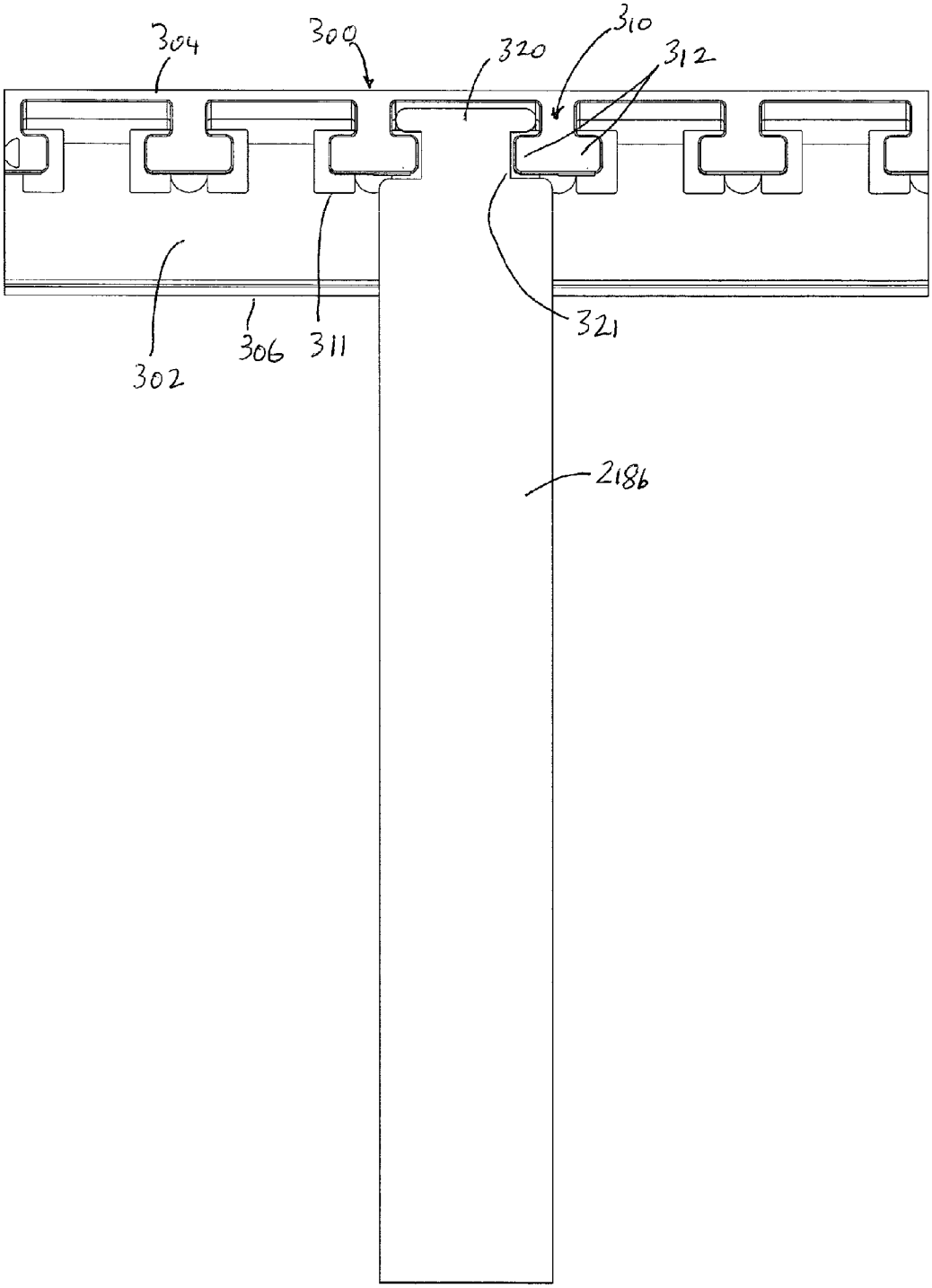
FIG. 61 is a vertical cross-section corresponding to FIG. 60 illustrating the inter engagement.
Figure 62:
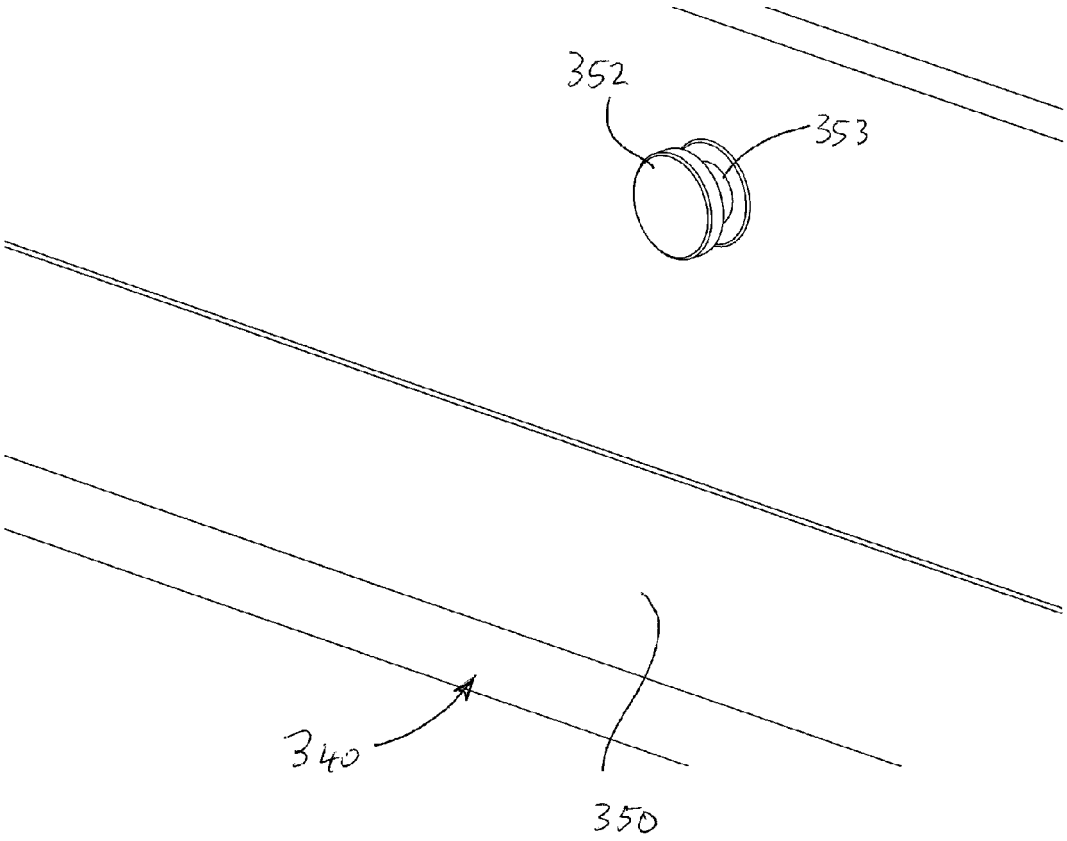
FIG. 62 is a fragmentary rear view of the detachable panel seen in FIG. 58.

Focussing first on FIGS. 58 and 59, it will be seen that the profile rail 220 is formed with a greater depth so that the passage 216 extends further rearwardly of the stepped profile than in the earlier embodiments in order to accommodate a slide-in location control element 300 broadly in the form of a longitudinal flat strip 302 with an upturned rear wall 304 and a depending bead 306 at its front edge. The bead engages with a matching undercut slot 307 in the forward floor of passage 216 while tray 302 and rear wall 304 snugly conform to the extending downwardly sloping rear surface 237 and rear wall 226 of passage 216. Once inserted, the upper surface of strip 302 is effectively contiguous with the first contact area 234 adjacent opening 228 and thereby effectively forms the rear downwardly sloping surface of the passage.

At spaced intervals along control element 300 in the rear of the control element are structure comprising upstanding lands 310 with overhanging tabs 312 in their forward halves so that the lands present a T-profile when viewed from the front and from above. Material saving apertures 311 are provided in strip 302 between lands 310.

Plug in elements in the form of arms 218*b* have a broad projection 320 at their rear end that is co-operable with the structure comprising upstanding lands 310 with tabs 312. To this end, the projection 320 is undercut 321 so as to provide a key portion that can pass under the tabs 312 when inserted at a slight downward angle, i.e. an insertion orientation, but locked behind tabs 312 when the cantilevered arm is tilted at its outer end to substantially horizontal, i.e. its engaged orientation. These two positions are respectively illustrated in broken and full lines in FIG. 61 and the locked in position is depicted from above in FIG. 60.

Slide-in location control element 300 allows arms or other plug in elements to be located at exact positions and, perhaps of greater importance, located at vertically matching positions in a whole wall array.

For mounting front panels 240 between vertically spaced profile rails, the front wall of the lower arm 224 of each profile rail 220, which is of hollow box construction, has a series of regularly spaced circular openings 332, while the upper arm or strut 222 carries regularly spaced metal plates 340 of steel or other magnetically interactive material. These plates have their front faces flush with the front face of upper arm 222 and are fastened by countersunk screws to support blocks 344 that in turn are slidingly mounted to upper arm 222 by engagement between a depending bead 346 on the support block and an undercut slot 347 in the upper arm.

Panel 240 has along its lower rear side a continuous magnetic polymer strip 350 and spaced from its upper edge a series of studs 352 with an undercut peripheral groove 353. Studs 352 are rearwardly inserted through openings 332 and the panel lowered to maintain it in place by resting groove 353 on the edges of openings 332. The openings 332 thus receive and hook complementary formation 352, 353. The magnetic polymer strip is in turn attracted to and engages the steel plates 340. The vertical height of a first size of panels 240 is selected so that when mounted their upper and lower edges are respectively flush with base contact area 234 of the upper profile rail and the raised ceiling section 256 of the lower profile rail, leaving in view only a longitudinal slot from which the plug in elements project. Other panels of different heights can be provided that selectively cover sections of unused front openings 228.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A suspension device for receiving plug in elements used for the display of goods, the device comprising:

a substantially horizontally oriented profile rail section having an upper arm, a lower arm, and a rear wall defining a passage having a front opening, wherein the upper arm defines a ceiling of the passage and the lower arm defines a base of the passage;

wherein the base of the passage includes a base contact surface located towards a front of the passage;

wherein the ceiling of the passage includes a stepped profile defining at least first and second generally horizontal upper contact surfaces towards a rear of the passage, wherein the first upper contact surface is located further forward within the passage, in a direction toward the front of the passage, than the second upper contact surface, wherein a vertical shoulder extends between the first and second upper contact surfaces;

wherein a vertical distance between the base contact surface and the first upper contact surface is greater than a vertical distance between the base contact surface and the second upper contact surface; and wherein the suspension device is configured to receive and hold a plug in element within the passage such that the plug in element contacts either the first upper contact surface or the second upper contact surface;

wherein the vertical shoulder is configured to prevent insertion of a plug in element beyond the vertical shoulder when a vertical height of the plug in element is greater than the vertical distance between the base contact surface and the second upper contact surface.

2. A suspension device according to claim 1, wherein the first and second generally horizontal upper contact surfaces are formed integrally with the profile rail section as an integral extrusion.

3. A suspension device according to claim 1, wherein the stepped profile of the passage ceiling is defined by an insert that is received within an upper channel formed in the upper arm, wherein the insert defines the first and second generally horizontal upper contact surfaces.

4. A suspension device according to claim 3, wherein the insert comprises electrically insulating material.

5. A suspension device according to claim 1, wherein two or more electrical conductors are integrated into the upper contact surfaces defined by the stepped profile.

6. A suspension device according to claim 5, wherein the electrical conductors are held within channels in the stepped profile, such that:

a first electrical conductor is exposed at the first upper contact surface and a second electrical conductor is exposed at the second upper contact surface, a vertical distance between the base contact surface and the first electrical conductor is greater than a vertical distance between the base contact surface and the second electrical conductor, and when a plug in element is inserted into the passage, a top surface of the plug in element directly contacts either the first electrical conductor or the second electrical conductor, wherein the vertical shoulder is configured to prevent the inserted plug in element from contacting the first and second electrical conductors simultaneously.

7. A suspension device according to claim 1, wherein the rear wall is angled to minimize an amount of light reflected back out of the profile rail through the front opening, whereby a visually darkened profile rail passage is provided when viewed from the front opening.

8. A suspension device according to claim 1, wherein an internal surface of the lower arm located rearward of the base contact surface slopes downwardly towards the rear wall, and the upper arm has a section defining an elevated ceiling contact surface located forward of the upper contact surfaces, wherein the internal surface and the elevated ceiling contact surface are configured to enable a plug in element to be inserted in an upwardly angled orientation and then lowered to substantially horizontal.

9. A suspension device according to claim 1, in combination with a plug in element with a rear top surface that includes an exposed electrically conductive section, wherein the suspension device and the plug in element are configured such that on contact of the exposed conductive section with the first or second electrical conductor in the first or second upper contact surface, electrical current is conducted from the first or second electrical conductor to the exposed conductive section and therethrough to an electrically powered device coupled to the plug in element.

10. A suspension device according to claim 9, wherein the plug in element is a composite panel having a core layer of electrically insulating material sandwiched between outer electrically conductive layers having respective outer faces, wherein said panel includes a bracket at an edge thereof, wherein the bracket includes, at a location outwardly of the edge, an electrical contact at a level offset from the outer face of one of said electrically conductive layers, wherein the bracket provides an electrical connection between said electrical contact and the other of said electrically conductive layers.

11. A suspension device according to claim 1, further including a slide-in location control element in said passage having structure configured to receive co-operating formations on respective plug in elements at defined locations along the profile rail section, wherein the structure is further configured to lock the plug in element in place when the plug in element is tilted from an insertion orientation to an engaged orientation.

12. A suspension device according to claim 11, wherein said structure comprises spaced upstanding lands with overhanging tabs, wherein the lands present a T-profile when viewed from the front and from above.

13. A suspension device according to claim 1, wherein the profile rail section has retaining structure arranged, above and below said front opening, wherein the retaining structure is configured to detachably retain panels that are configured to extend between the profile rail section and adjacent vertically spaced apart profile rail sections.

14. A suspension device according to claim 13, wherein said retaining structure includes magnetically attractive elements, and openings configured to receive and hook complementary formations on the panels.

* * * * *